US007073559B2

(12) United States Patent
O'Larey et al.

(10) Patent No.: US 7,073,559 B2
(45) Date of Patent: Jul. 11, 2006

(54) METHOD FOR PRODUCING METAL FIBERS

(75) Inventors: Philip M. O'Larey, Albany, OR (US); John J. Hebda, Albany, OR (US); Ronald A. Graham, Salem, OR (US)

(73) Assignee: ATI Properties, Inc., Albany, OR (US)

( * ) Notice: Subject to any disclaimer, the term of this patent is extended or adjusted under 35 U.S.C. 154(b) by 0 days.

(21) Appl. No.: 10/612,232

(22) Filed: Jul. 2, 2003

(65) Prior Publication Data

US 2005/0000321 A1 Jan. 6, 2005

(51) Int. Cl.
*B22D 11/00* (2006.01)

(52) U.S. Cl. ..... 164/76.1; 164/69.1; 164/462; 164/423; 148/513; 148/561; 148/403; 148/422; 148/423

(58) Field of Classification Search ..... 164/76.1, 164/69.1, 462, 423; 148/513, 561, 403, 422, 148/423

See application file for complete search history.

(56) References Cited

U.S. PATENT DOCUMENTS 3,729,794 A * 5/1973 Douglass ..... 428/567
3,849,124 A * 11/1974 Villani et al. ..... 420/422
4,278,623 A * 7/1981 Niegisch ..... 264/28
4,378,330 A * 3/1983 Verhoeven et al. ..... 420/432
4,415,635 A 11/1983 Wilsdorf et al.
4,502,884 A 3/1985 Fife
4,629,515 A * 12/1986 Imaizumi et al. ..... 419/3
5,245,514 A * 9/1993 Fife et al. ..... 361/529
5,252,147 A * 10/1993 Verhoeven et al. ..... 148/237
5,284,531 A 2/1994 Fife
5,306,462 A 4/1994 Fife
5,326,525 A 7/1994 Ghosh
5,869,196 A 2/1999 Wong et al.
5,908,587 A * 6/1999 Gross et al. ..... 264/28
6,521,173 B1 * 2/2003 Kumar et al. ..... 419/23
6,709,536 B1 * 3/2004 Kim et al. ..... 148/561

OTHER PUBLICATIONS

Wah Chang, Nb/nB Alloy Products, "C–103".
Raabe, D., and Hangen, U., "Observation of amorphous areas in a heavily cold rolled Cu–20 wt% Nb composite," Materials Letters 22, (1995), 155–161.
Roberge, R., et al., "Ultrafine Fiber In Situ Cu–Nb–Sn–Produced By High Temperature Gradient Solidification," IEEE Transactions on Magnetics, vol. Mag–19, No. 3, May 1983, 560–562.
International Search Report of the International Searching Authority for International Application No. PCT/US2004/021091 (filed Jun. 30, 2004), European Patent Office, Feb. 2, 2005.
Raabe, D., and Hangen, U., "Observation of amoorphous areas in a heavily cold rolled Cu–20 wt% Nb composite," Materials Letters 22, (1995), 155–161.*

* cited by examiner

*Primary Examiner*—Kevin Kerns
*Assistant Examiner*—I.-H. Lin
(74) *Attorney, Agent, or Firm*—Kirkpatrick & Lockhart Nicholson Graham LLP

(57) ABSTRACT

A method of producing metal fibers including melting a mixture of at least a fiber metal and a matrix metal, cooling the mixture to form a bulk matrix comprising at least a fiber phase and a matrix phase and removing at least a substantial portion of the matrix phase from the fiber phase. Additionally, the method may include deforming the bulk matrix.

In certain embodiments, the fiber metal may be at least one of niobium, a niobium alloy, tantalum and a tantalum alloy and the matrix metal may be at least one of copper and a copper alloy. The substantial portion of the matrix phase may be removed, in certain embodiments, by dissolving of the matrix phase in a suitable mineral acid, such as, but not limited to, nitric acid, sulfuric acid, hydrochloric acid and phosphoric acid.

63 Claims, 29 Drawing Sheets

METHOD FOR PRODUCING METAL FIBERS

TECHNICAL FIELD AND INDUSTRIAL APPLICABILITY OF THE INVENTION

The present invention relates to a method for producing metal fibers. More particularly, the present invention relates to a method for producing metal fibers which may be used for use in capacitors, filtration medium, catalyst supports or other high surface area or corrosion resistant applications.

DESCRIPTION OF THE INVENTION BACKGROUND

Metal fibers have a wide range of industrial applications. Specifically, metal fibers which retain their properties at high temperature and in corrosive environments may have application in capacitors, filtration media, and catalyst supports structures.

There has been increasing demand for miniature capacitors for the modern electronics industry. Capacitors comprising tantalum have been produced in small sizes and are capable of maintaining their capacitance at high temperatures and in corrosive environments. In fact, presently, the largest commercial use of tantalum is in electrolytic capacitors. Tantalum powder metal anodes are used in both solid and wet electrolytic capacitors and tantalum foil may be used to produce foil capacitors.

Tantalum may be prepared for use in capacitors by pressing a tantalum powder into a compact and subsequently sintering the compact to form a porous, high surface area pellet. The pellet may then be anodized in an electrolyte to form the continuous dielectric oxide film on the surface of the tantalum. The pores may be filled with an electrolyte and lead wires attached to form the capacitor.

Tantalum powders for use in capacitors have been produced by a variety of methods. In one method, the tantalum powder is produced from a sodium reduction process of $K_2TaF_2$. The tantalum product of sodium reduction can then be further purified through a melting process. The tantalum powder produced by this method may be subsequently pressed and sintered into bar form or sold directly as capacitor grade tantalum powder. By varying the process parameters of the sodium reduction process such as time, temperature, sodium feed rate, and diluent, powders of different particle sizes may be manufactured. A wide range of sodium reduced tantalum powders are currently available that comprise unit capacitances of from 5000 μF·V/g to greater than 25,000 μF·V/g.

Additionally, tantalum powders have been produced by hydrided, crushed and degassed electron beam melted ingot. Electron beam melted tantalum powders have higher purity and have better dielectric properties than sodium reduced powders, but the unit capacitance of capacitors produced with these powders is typically lower.

Fine tantalum filaments have also been prepared by a process of combining a valve metal with a second ductile metal to form a billet. The billet is worked by conventional means such as extrusion or drawing. The working reduces the filament diameter to the range of 0.2 to 0.5 microns in diameter. The ductile metal is subsequently removed by leaching of mineral acids, leaving the valve metal filaments intact. This process is more expensive than the other methods of producing tantalum powders and therefore has not been used to a wide extent commercially.

Additionally, the process described above has been modified to include an additional step of surrounding a billet substantially similar to the billet described above with one or more layers of metal that will form a continuous metal sheath. The metal sheath is separated from the filament array by the ductile metal. The billet is then reduced in size by conventional means, preferably by hot extrusion or wire drawing to the point where the filaments are of a diameter less than 5 microns and the thickness of the sheath is 100 microns or less. This composite is then cut into lengths appropriate for capacitor fabrication. The secondary, ductile metal that served to separate the valve metal components is then removed from the sections by leaching in mineral acids.

Further processing may be used to increase the capacitance of tantalum by ball milling the tantalum powders. The ball milling may convert substantially spherical particles into flakes. The benefit of the flakes is attributed to their higher surface area to volume ratio than the original tantalum powders. The high surface area to volume ratio results in a greater volumetric efficiency for anodes prepared by flakes. Modification of tantalum powders by ball milling and other mechanical processes has practical drawbacks, including increased manufacturing costs, and decrease in finished product yields.

Niobium powders may also find use in miniature capacitors. Niobium powders may be produced from an ingot by hydriding, crushing and subsequent dehydriding. The particle structure of the dehydrided niobium powder is analogous to that of tantalum powder.

Tantalum and niobium are ductile in a pure state and have high interstitial solubility for carbon, nitrogen, oxygen, and hydrogen. Tantalum and niobium may dissolve sufficient amounts of oxygen at elevated temperatures to destroy ductility at normal operating temperatures. For certain applications, dissolved oxygen is undesirable. Therefore, elevated temperature fabrication of these metal fibers is typically avoided.

Thus, there exists a need for an economical method for producing metal fibers. More particularly, there exists a need for an economical method for producing metal fibers comprising tantalum or niobium for use in capacitors, filter medium and catalyst supports, as well as other applications.

SUMMARY OF THE INVENTION

The method of producing metal fibers includes melting a mixture of at least a fiber metal and a matrix metal, cooling the mixture, and forming a bulk matrix comprising at least a fiber phase and a matrix phase and removing at least a substantial portion of the matrix phase from the fiber phase. Additionally, the method may include deforming the bulk matrix.

In certain embodiments, the fiber metal may be at least one of niobium, a niobium alloy, tantalum and a tantalum alloy and the matrix metal may be at least one of copper and a copper alloy. The substantial portion of the matrix phase may be removed, in certain embodiments, by dissolving of the matrix phase in a suitable mineral acid, such as, but not limited to, nitric acid, sulfuric acid, hydrochloric acid and phosphoric acid.

The reader will appreciate the foregoing details and advantages of the present invention, as well as others, upon consideration of the following detailed description of embodiments of the invention. The reader also may comprehend such additional details and advantages of the present invention upon making and/or using the metal fibers of the present invention.

BRIEF DESCRIPTION OF THE FIGURES

The features and advantages of the present invention may be better understood by reference to the accompanying figures in which.

DETAILED DESCRIPTION OF EMBODIMENTS OF THE INVENTION

The present invention provides a method for producing metal fibers. An embodiment of the method for producing metal fibers comprises melting a mixture of at least a fiber metal and a matrix metal: cooling the mixture to form a bulk matrix comprising at least two solid phases including a fiber phase and a matrix phase; and removing a substantial portion of the matrix phase from the fiber. In certain embodiments, the fiber phase is shaped in the form of fibers or dendrites in the matrix phase. See FIGS. 1, 2, 8, 9, 10 and 12A–12C. In certain embodiments, the fiber metal may be at least one metal selected from the group consisting of tantalum, a tantalum containing alloy, niobium and a niobium containing alloy.

The matrix metal may be any metal that upon cooling of a liquid mixture comprising at least the matrix metal and a fiber metal may undergo an eutectic reaction to form a bulk matrix comprising at least a fiber phase and a matrix phase. The matrix phase may subsequently be at least substantially removed from the fiber phase to expose the metal fibers. See FIGS. 5A–5H, 6A–6D, and 7A–7E. In certain embodiments, the matrix metal may be, for example, copper or bronze. A substantial portion of the matrix phase is considered to be removed from the bulk matrix if the resulting metal fibers are applicable for the desired application.

The fiber metal may be any metal, or any alloy that comprises a metal, that is capable of forming a solid phase in a matrix phase upon cooling. Embodiments of the invention may utilize a fiber metal in any form including, but not necessarily limited to, rods, plate machine chips, machine turnings, as well as other coarse or fine input stock. For certain embodiments, fine or small-sized material may be desirable. The method for forming fibers represents a potentially significant improvement over other methods of forming metal fibers which must use only metal powders as a starting material. Preferably, upon mixing of the fiber metal and the matrix metal the resulting mixture has a lower melting point than either of the matrix metal and the fiber metal individually.

Figure 1:
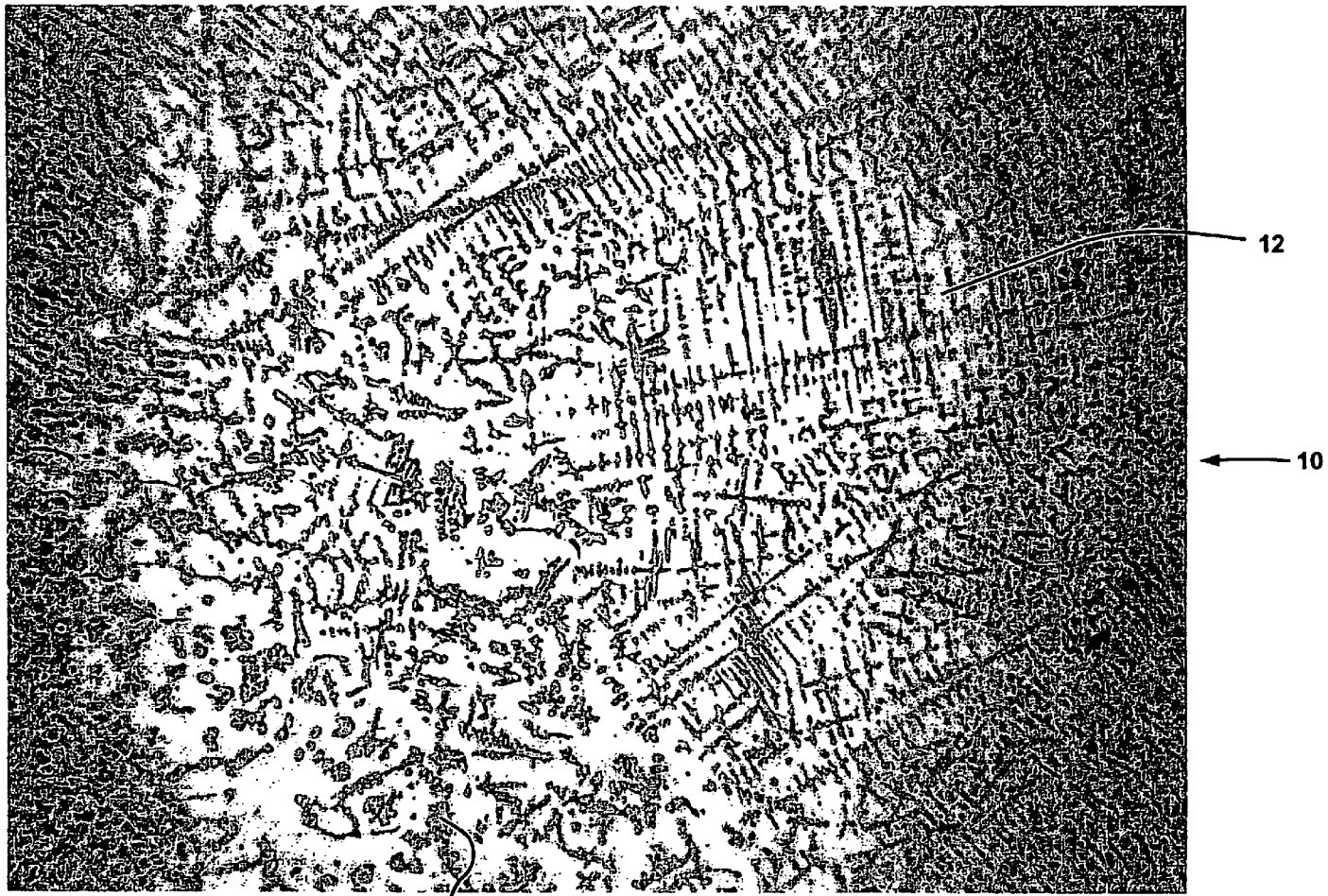
FIG. 1 is a photomicrograph of a cross section of a bulk matrix at 200 times magnification prepared from an embodiment of the method of the invention comprising melting a mixture including C-103 and copper, the photomicrograph showing the dendritic shape of the fiber phase in the matrix phase.
Figure 2:
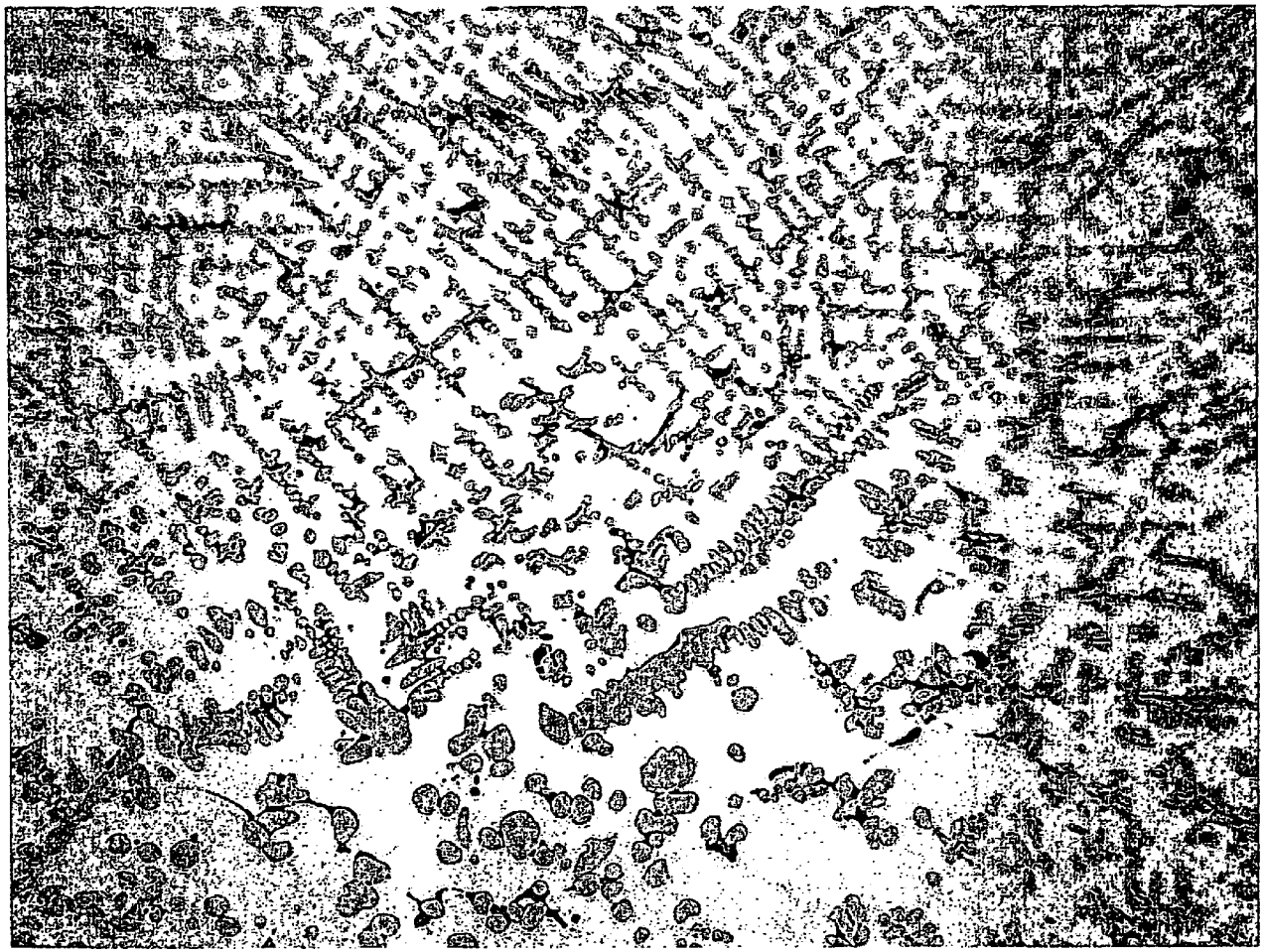
FIG. 2 is a photomicrograph of a cross section of a bulk matrix of FIG. 1 at 500 times magnification, the photomicrograph showing the dendritic shape of the fiber phase in the matrix phase.

In an embodiment, the fiber metal forms a fiber phase in the shape of fibers or dendrites upon cooling of the mixture of fiber metal and matrix metal. FIGS. 1 and 2 are 200 times magnification photomicrographs of a bulk matrix 10 comprising a fiber phase 11 and a matrix phase 12. The fiber phase is in the shape of fibers or dendrites in a matrix of the matrix phase 12. The bulk matrix 10 was formed by melting a mixture including C-103, a niobium alloy and copper. The C-103 used in this embodiment comprises niobium, 10 wt. % hafnium, 0.7–1.3 wt. % titanium, 0.7 wt. % zirconium, 0.5 wt. % titanium, 0.5 wt. % tungsten, and incidental impurities. The melting point of C-103 is 2350±50° C. (4260±90° F.). The weight percentage of the fiber metal in the mixture may be any concentration that will result in two or more mixed solid phases upon cooling. In certain embodiments, the fiber metal may comprise any weight percentage from greater than 0 wt. % to 70 wt. %. However, in embodiments directed to forming higher surface area fibers, the concentration of fiber metal in the mixture may be reduced to less than 50 wt. %. In other embodiments, if it is desired to increase the yield of fibers from the method, the amount of fiber metal may be increased to 5 wt. % up to 50 wt. % or even 15 wt. % to 50 wt. %. For embodiments in certain applications wherein both yield of fibers and high surface area of the metal fibers is desired, the concentration of fiber metal in the mixture may be from 15 to 25 wt. % fiber metal. The mixture comprising the matrix metal and the fiber metal may be a eutectic mixture. A eutectic mixture is a mixture wherein an isothermal reversible reaction may occur in which a liquid solution is converted into at least two mixed solids upon cooling. In certain embodiments, it is preferable that at least one of the phases forms a dendritis structure.

The method for producing metal fibers may be used for any fiber metal, including but not limited to niobium, alloys comprising niobium, tantalum and alloys comprising tantalum. Tantalum is of limited availability and high cost. It has been recognized that in many corrosive media, corrosion resistant performance equivalent to pure tantalum may be achieved with niobium, alloys of niobium, and alloys of niobium and tantalum at a significantly reduced cost. In an embodiment, the method of producing fibers comprises an alloy of niobium or an alloy of tantalum that would be less expensive than tantalum.

Metal fibers having a surface area of 3.62 square meters per gram with average lengths of 50 to 150 microns and widths of 3 to 6 microns have been obtained with embodiments of the method of the present invention. Additionally, oxygen concentration in the fiber phase has been limited to 1.5 weight percent or less.

The fiber phase may be in the form of dendrites or fibers in a matrix phase. For example, FIG. 1 shows dendrites of niobium 11 in a copper matrix 12. The dendrites form as the mixture of the metals cools and solidifies. A fiber metal in a melt with a matrix metal, such as the niobium in melt with copper, upon cooling will first nucleate into a small crystal, then the crystals may continue to grow into dendrites. "Dendrites" are typically described as metallic crystals that have a treelike branching pattern. As used herein, "dendrites" or "dendritic" also includes fiber phase material in the shape of fibers, needles, and rounded or ribbon-shaped crystals. Under certain conditions, such as with a high concentration of fiber metal, the dendrites of the fiber metal may further progressively grow into crystalline grains.

The morphology, size, and aspect ratio of the dendrites of the fiber metal in the matrix metal may be modified by adjusting the process parameters. The process parameters which may control the morphology, size, and aspect ratio of the dendrites or fibers include but are not limited to the ratio of metals in the melt, the melting rate, the solidification rate, the solidification geometry, the melting or solidification methods (such as, for example rotating electrode or splat powder processing), the molten pool volume, and the addition of other alloying elements. The formation of dendrites in a molten eutectic matrix may be considerably less time consuming and less expensive route toward the production of metal fibers than simply mechanically working a mixture of metals to form the fiber phase.

Any melting process may be used to melt the fiber metal and the matrix metal, such as, but not limited to, vacuum or inert gas metallurgical operations such as VAR, induction melting, continuous casting, continuous casting strip over cooled counter rotating rolls, "squeeze" type casting methods, and melting.

Figure 3:
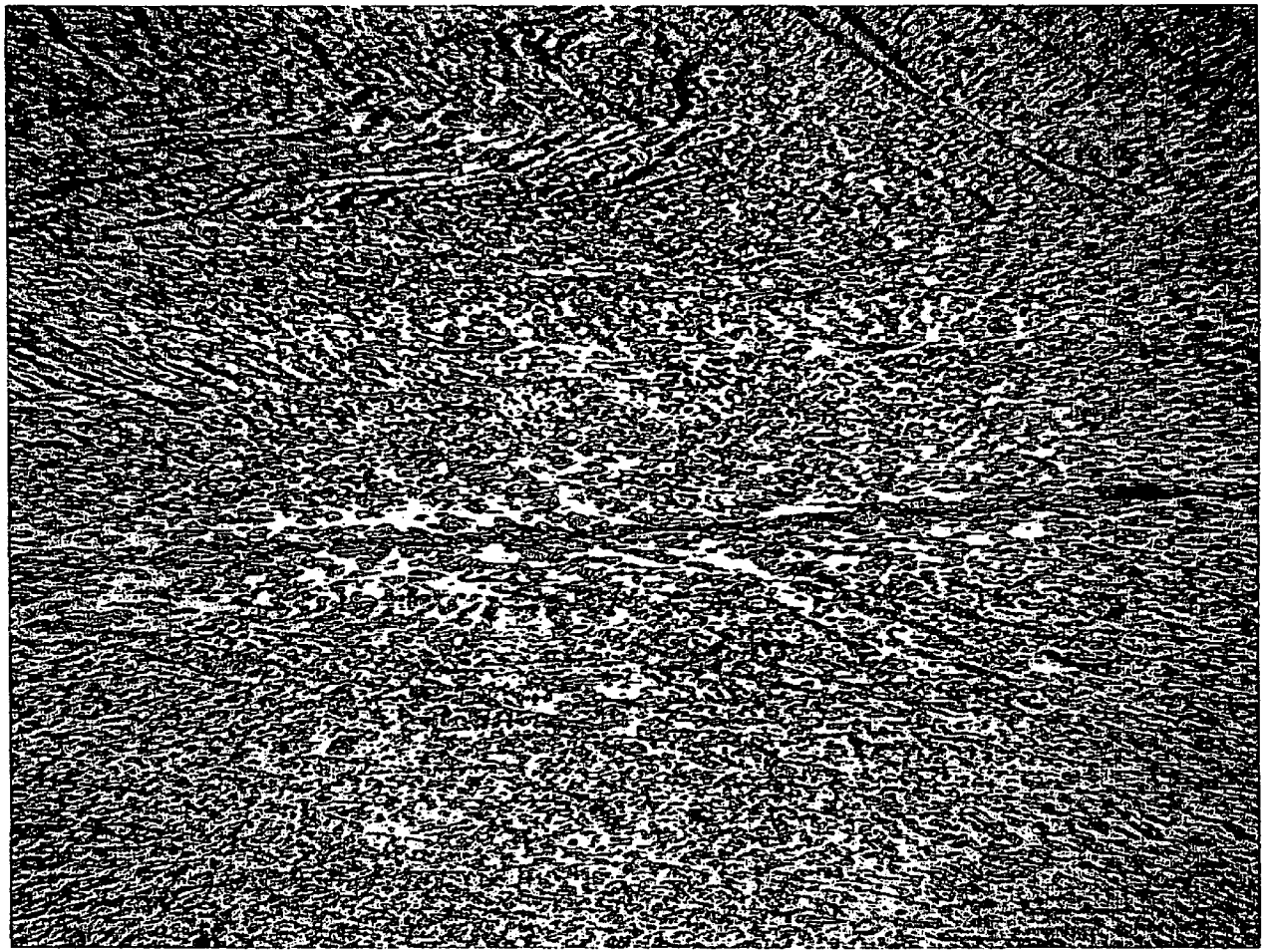
FIG. 3 is a photomicrograph of a cross section of a bulk matrix prepared from melting a mixture including C-103 and copper and mechanically processing the bulk matrix into a sheet at 500 times magnification, the photomicrograph showing the effect of deforming the bulk matrix on the dendritic shape of the fiber phase in the matrix phase.
Figure 4A:
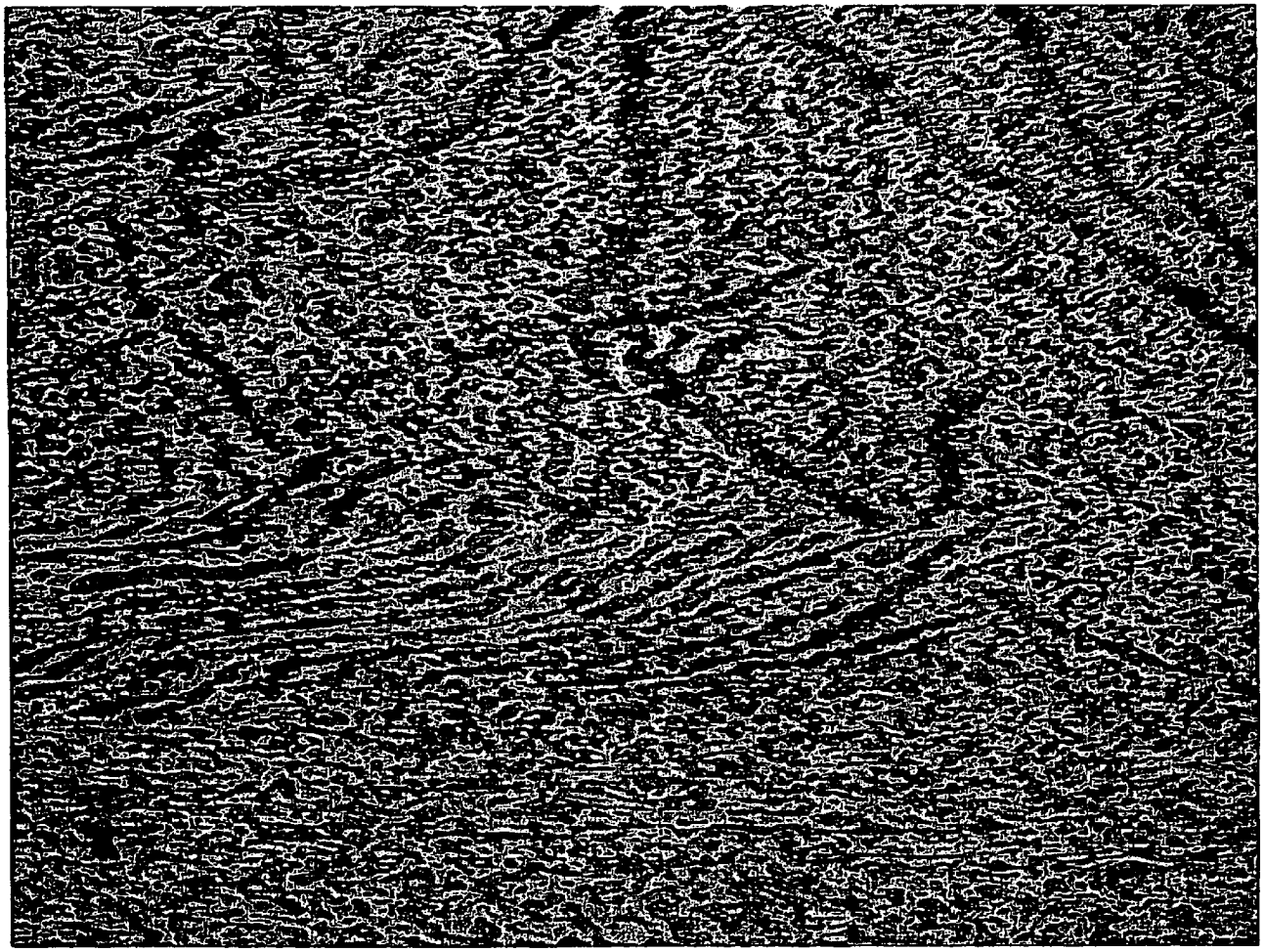
FIG. 4A and FIG. 4B are photomicrographs of a cross section of a bulk matrix of FIG. 3 at 1000 times magnification, the photomicrographs showing the effect of deforming the bulk matrix on the dendritic shape of the fiber phase in the matrix phase.
Figure 4B:
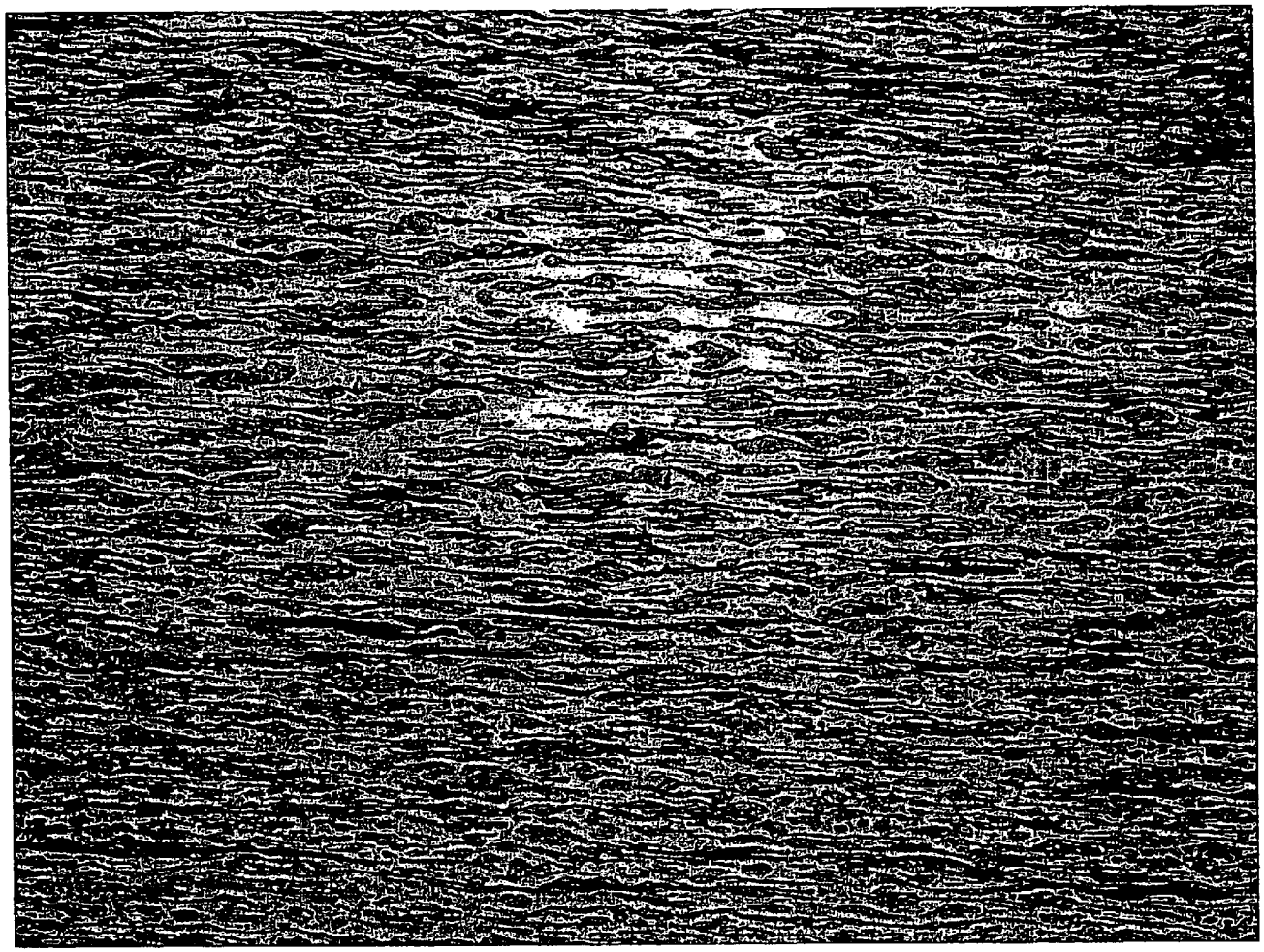
Figure 5A:
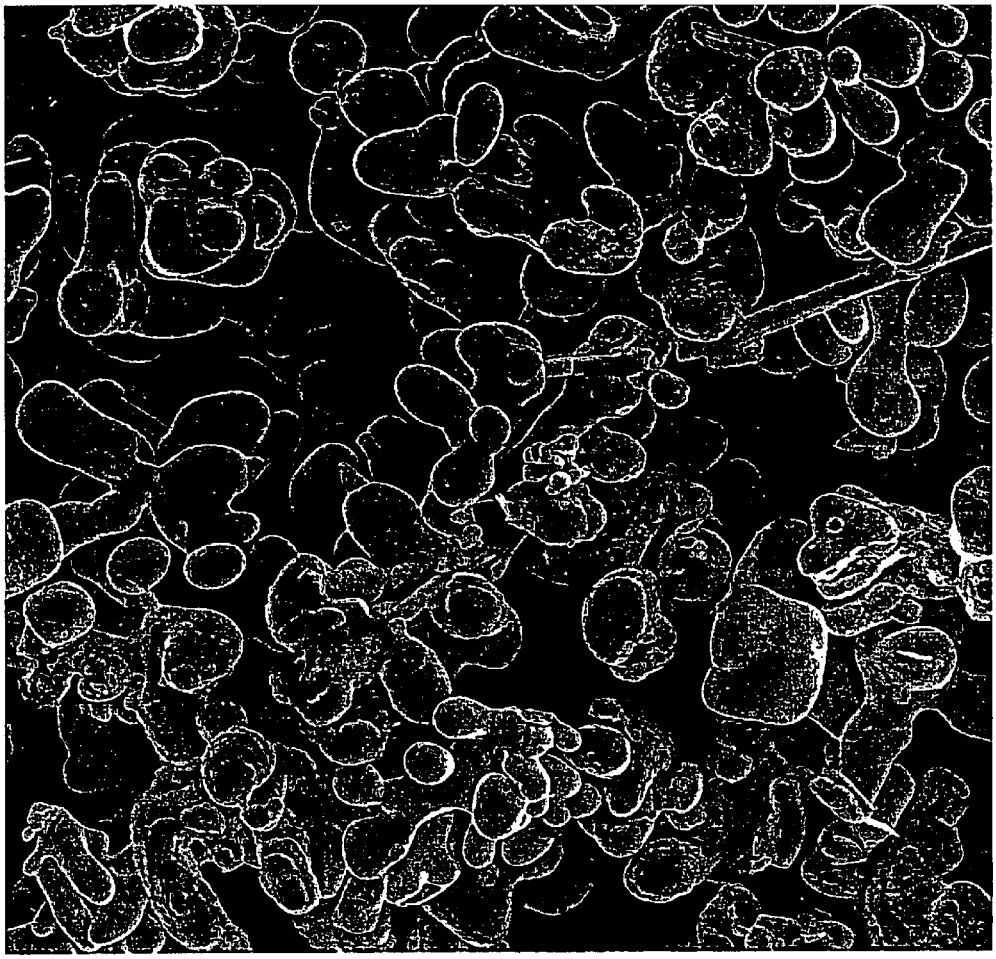
FIGS. 5A, 5B, 5C, 5D, 5E, 5F, 5G, and 5H are photomicrographs from a scanning electron microscope ("SEM") of some of the shapes of fibers produced from embodiments of the method of the present invention comprising melting a mixture including niobium and copper into a bulk matrix and removing the matrix phase from the bulk phase.
Figure 5B:
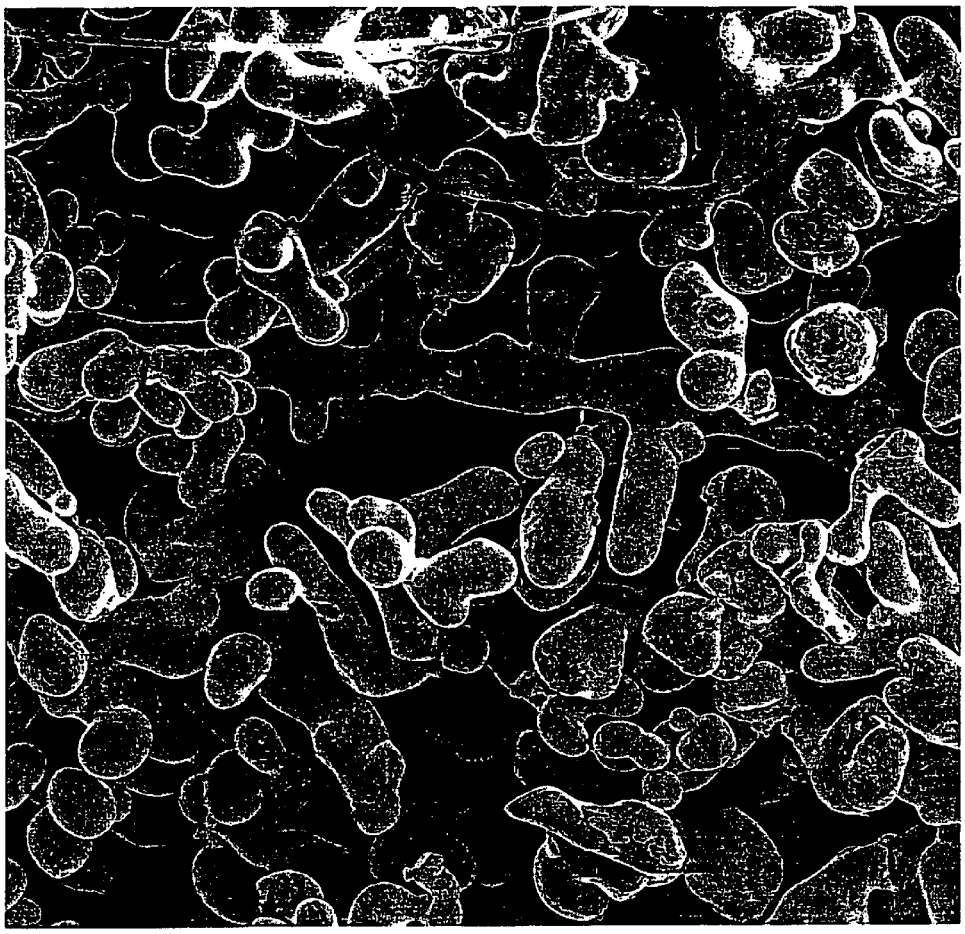
Figure 5C:
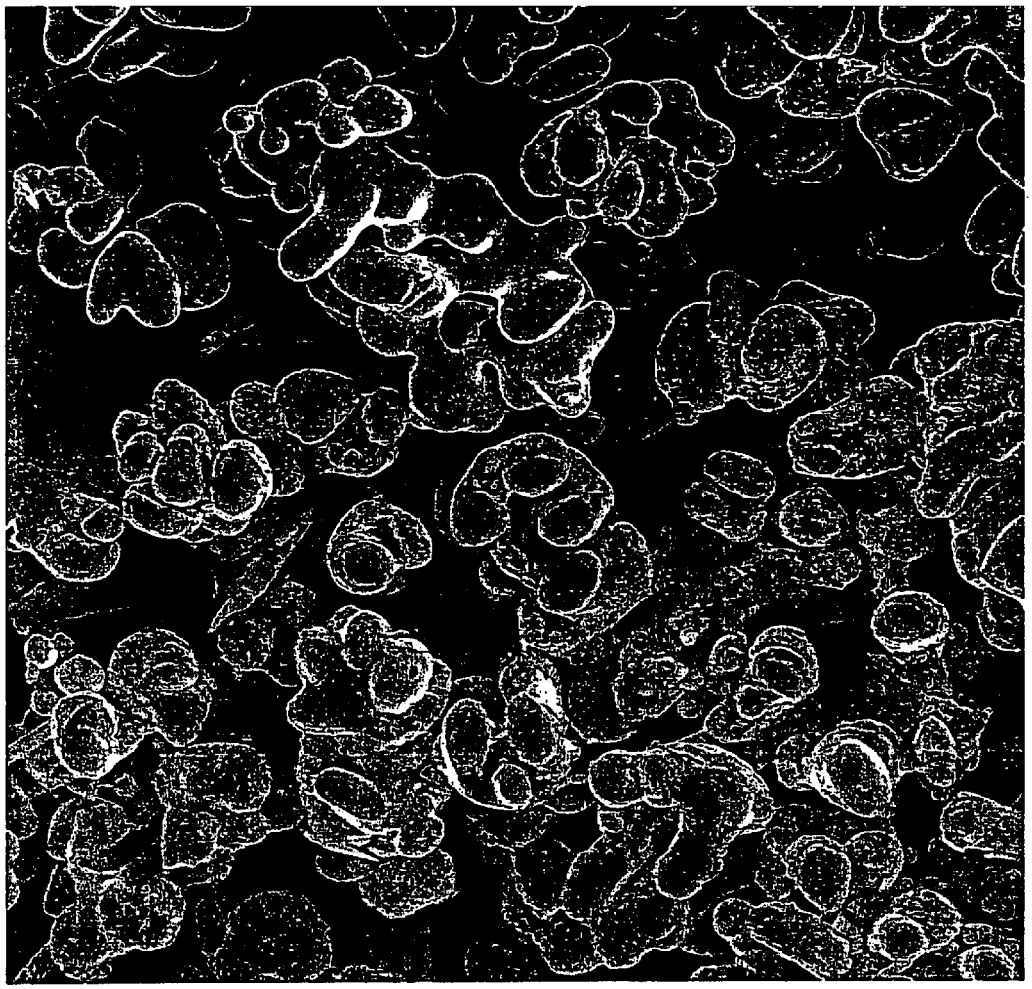
Figure 5D:
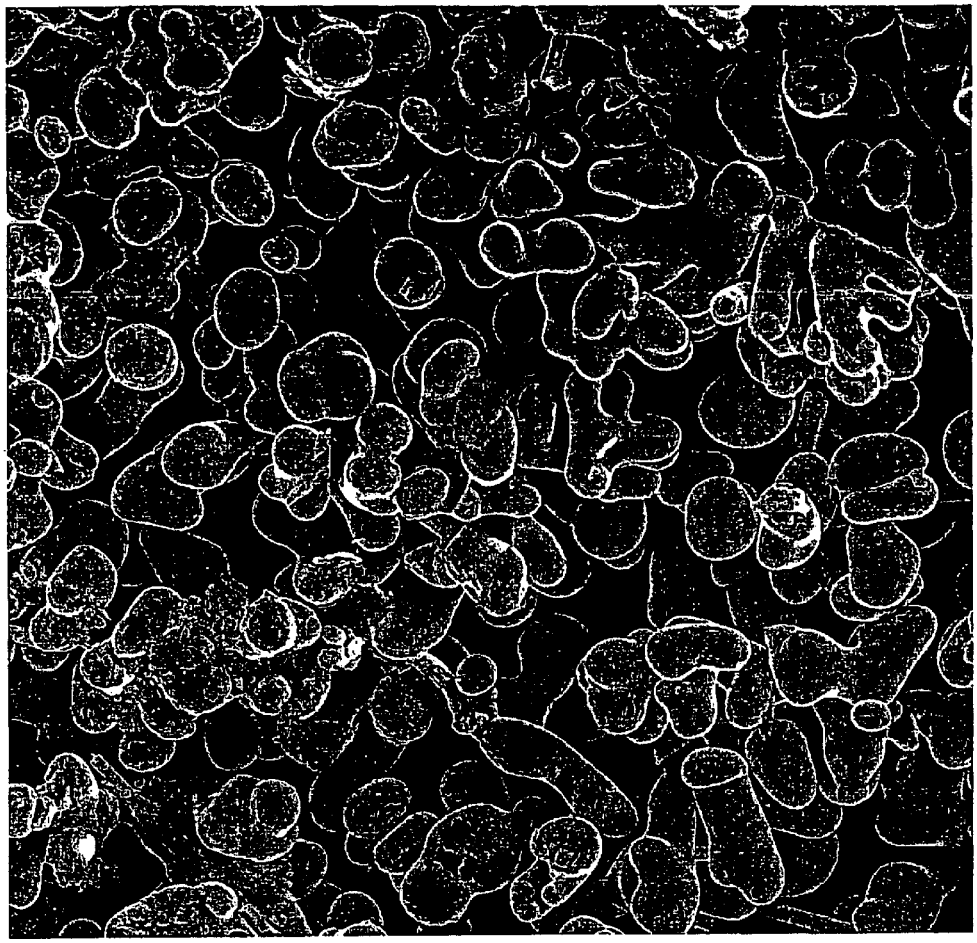
Figure 5E:
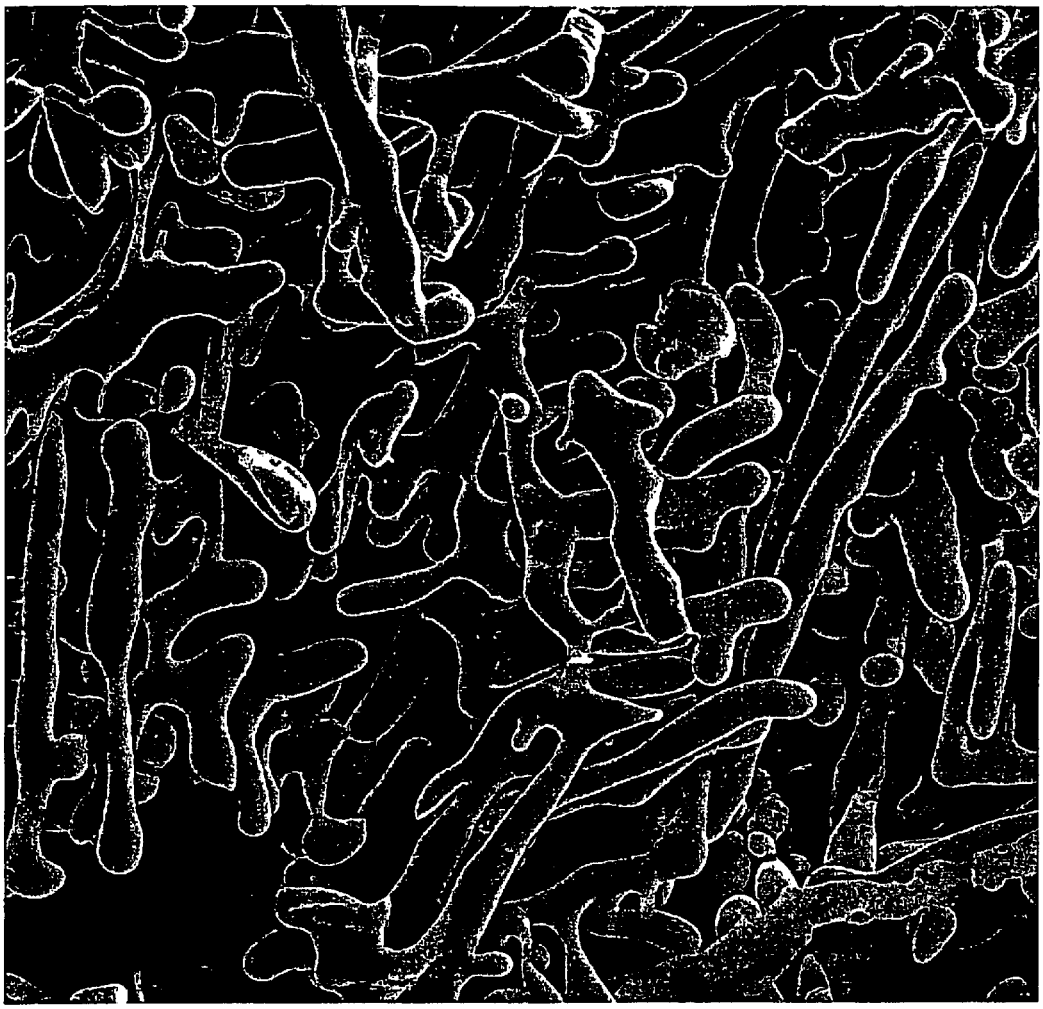
Figure 5F:
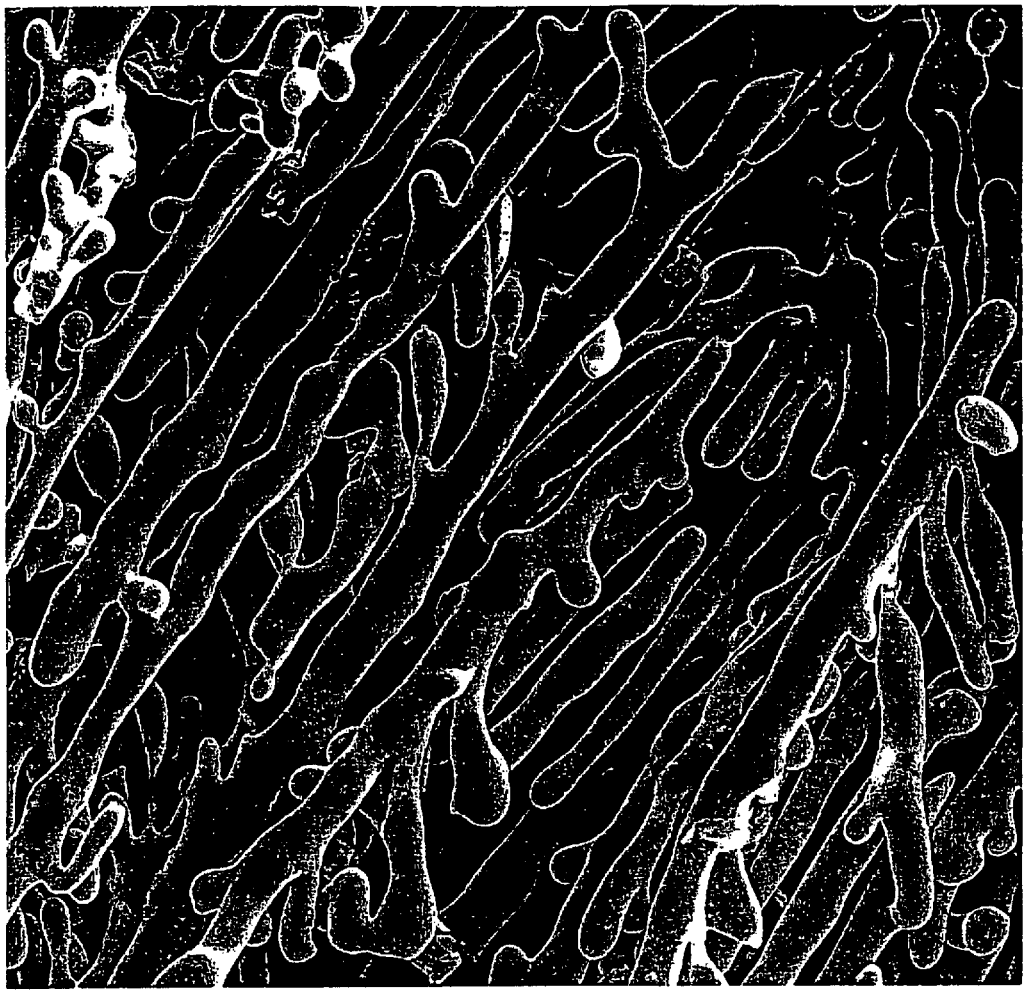
Figure 5G:
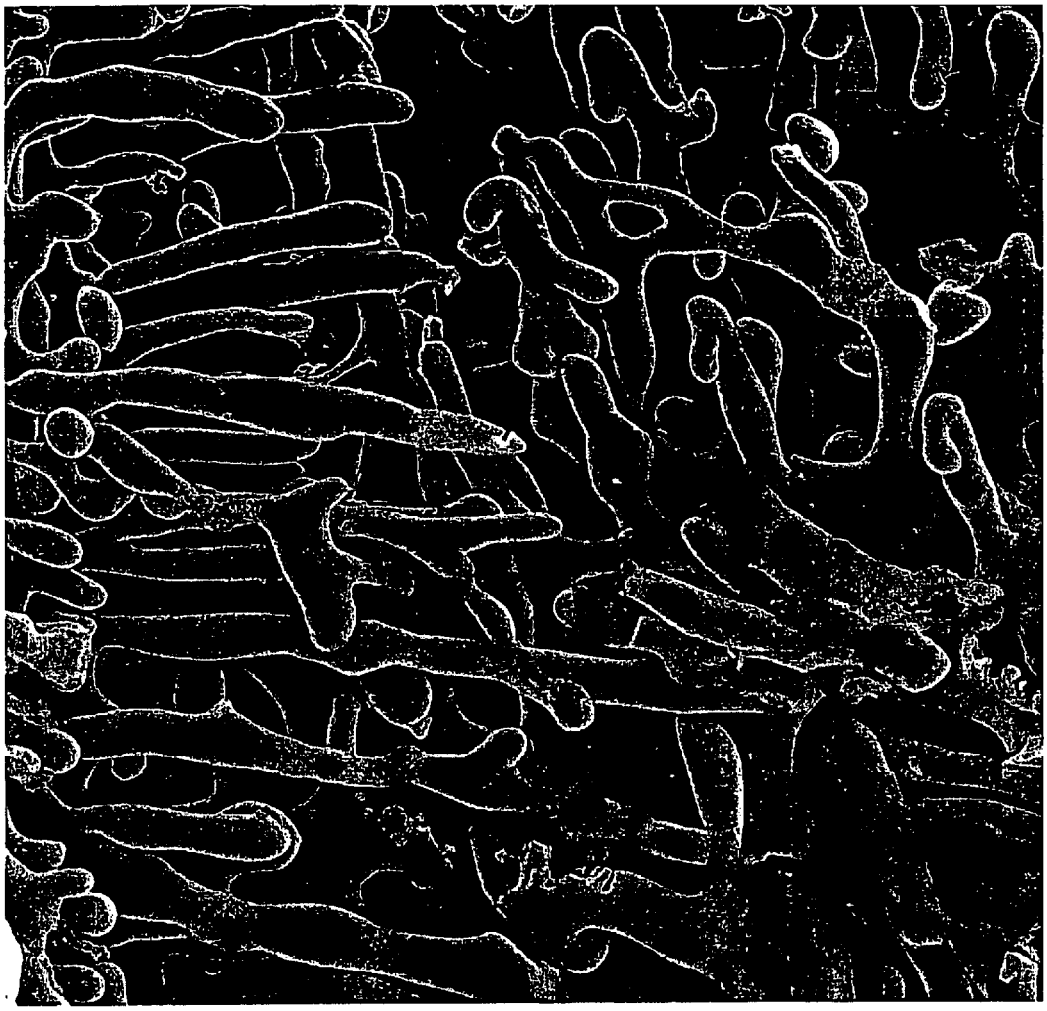
Figure 5H:
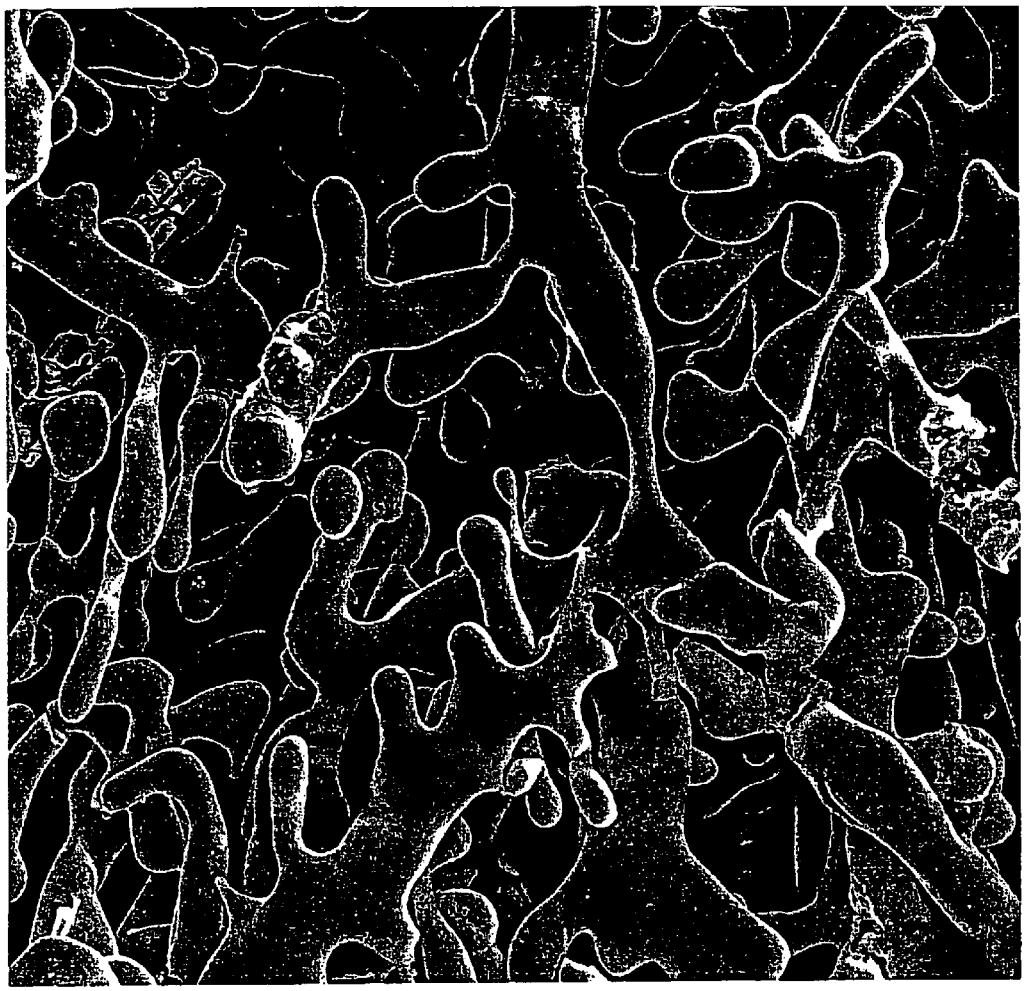
Figure 6A:
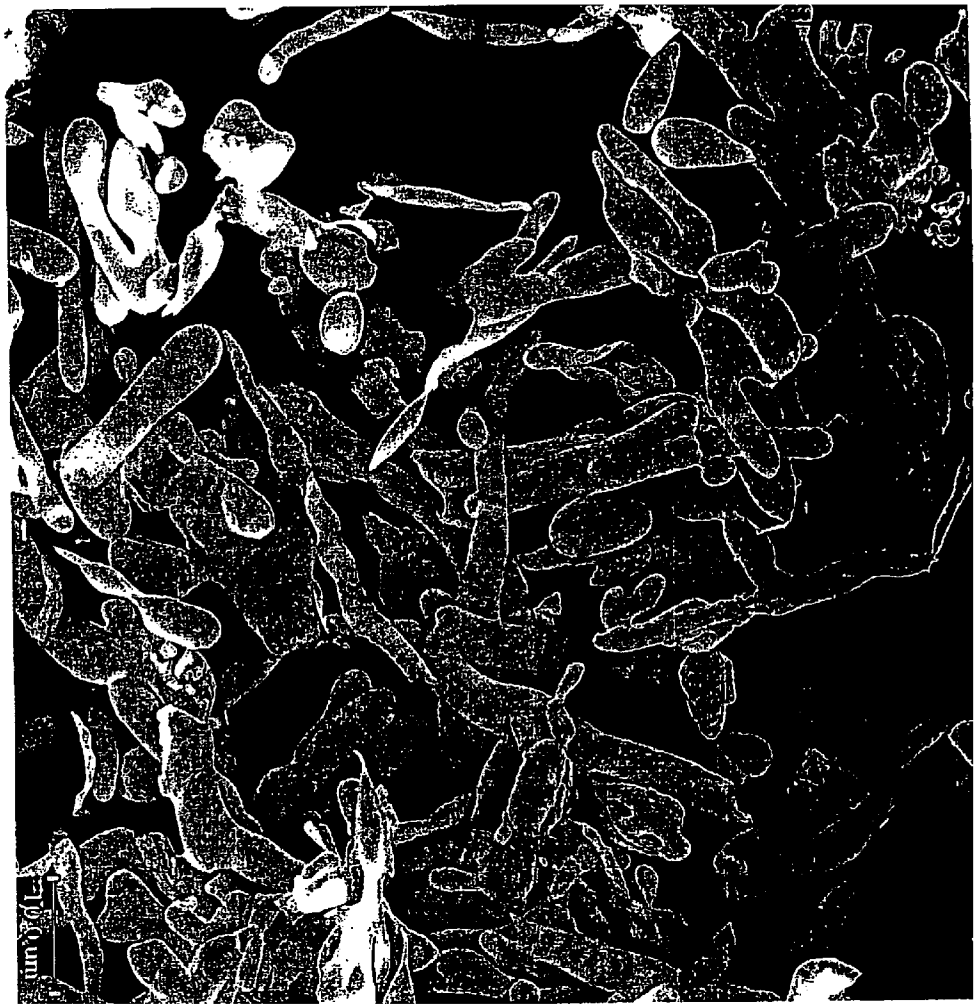
FIGS. 6A, 6B, 6C, and 6D are photomicrographs using secondary electron imaging ("SEI") of some of the shapes of fibers at 1000 times magnification produced from embodiments of the method of the present invention comprising melting a mixture including niobium and copper into a bulk matrix and removing the matrix phase from the bulk phase.
Figure 6B:
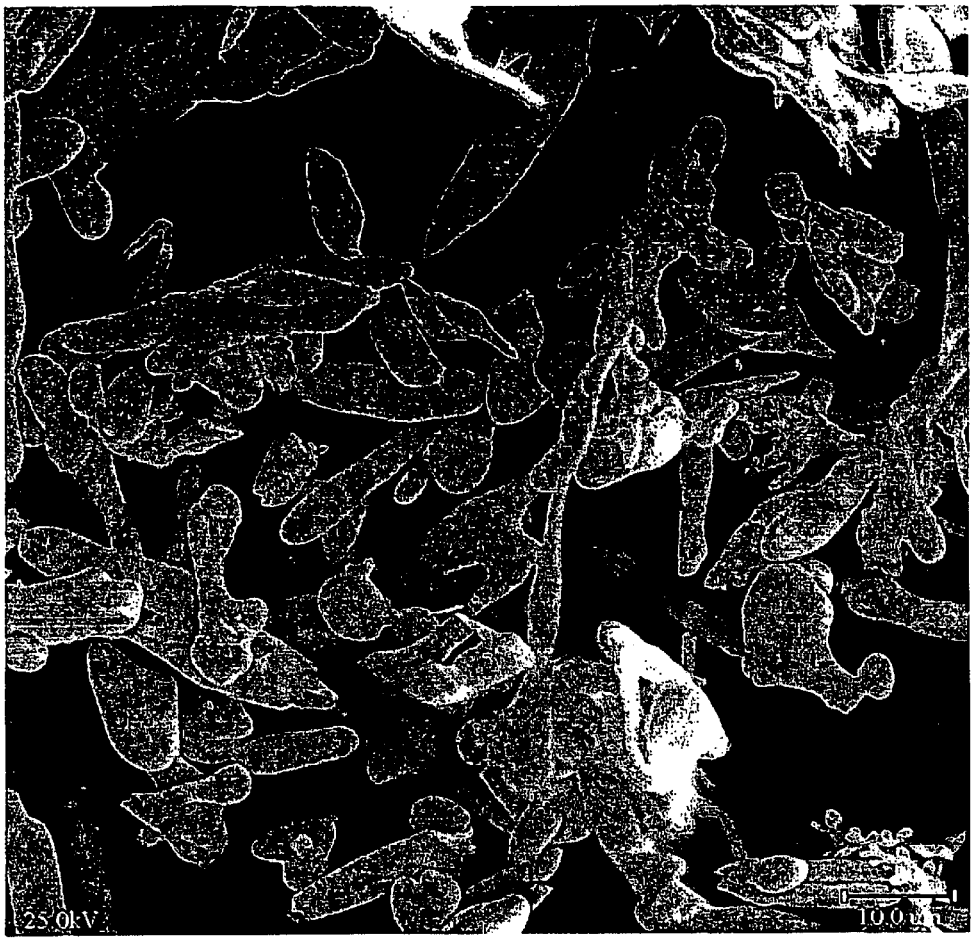
Figure 6C:
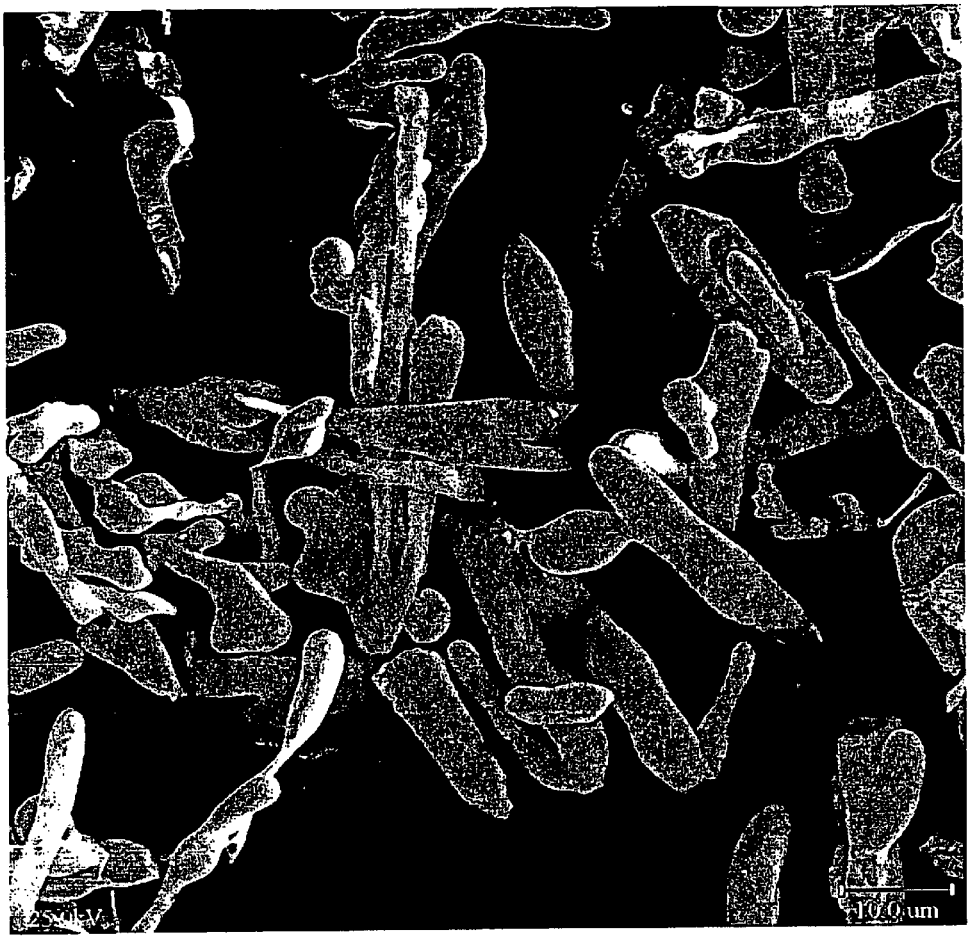
Figure 6D:
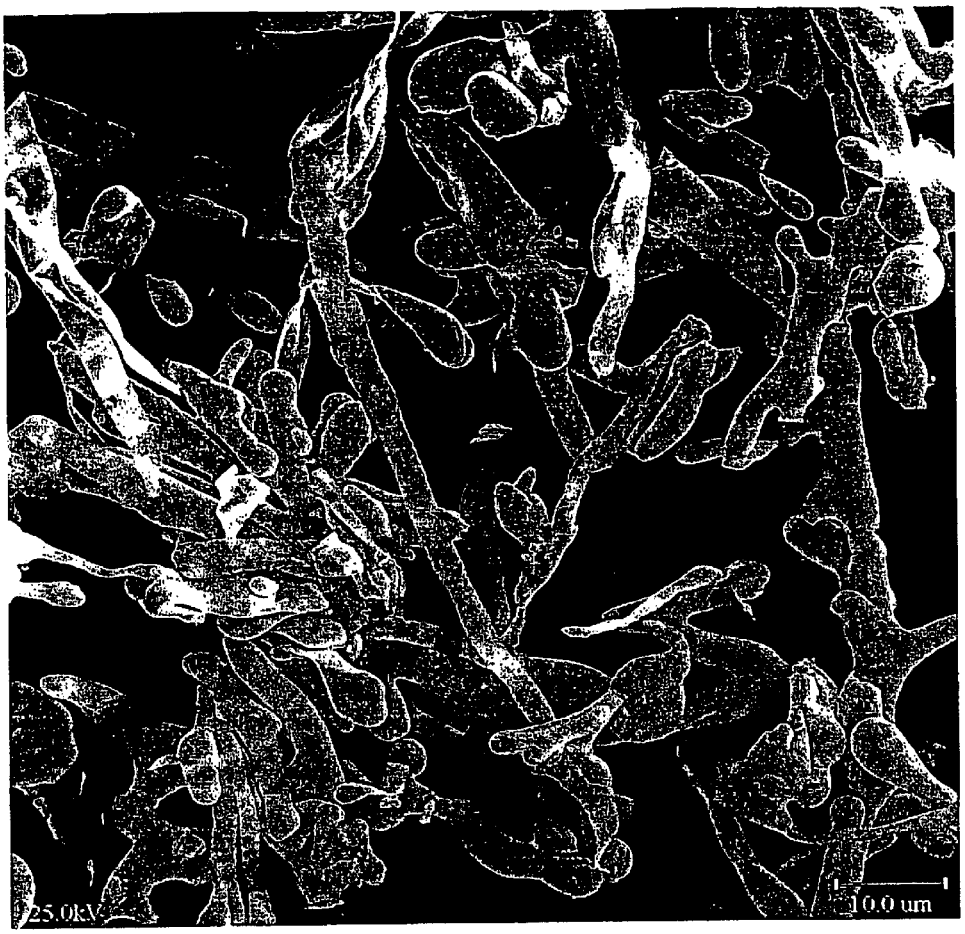
Figure 7A:
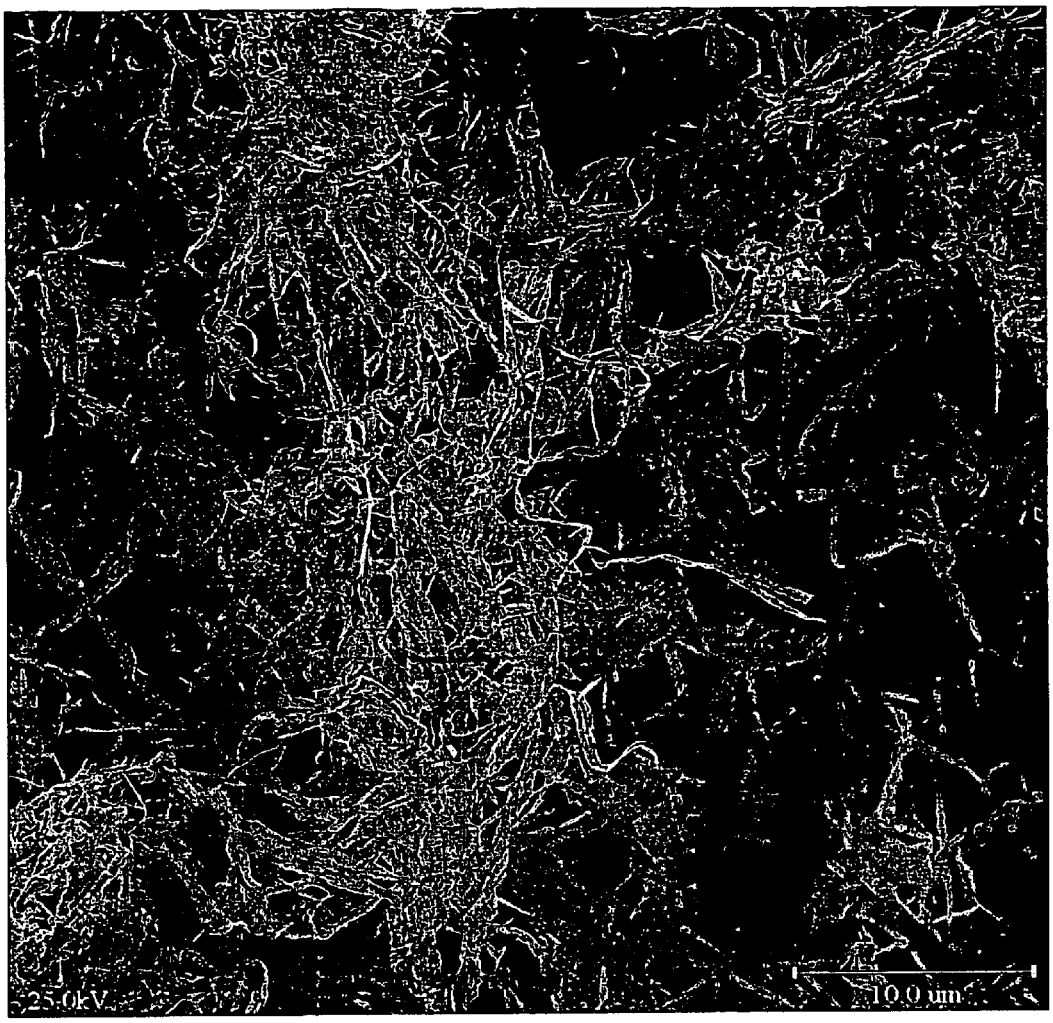
FIG. 7A is photomicrograph using SEI of some of the shapes of fibers at 200 times magnification produced from an embodiment of the method of the present invention comprising melting a mixture including C-103 and copper into a bulk matrix and removing the matrix phase from the bulk phase after deformation via rolling.
Figure 7B:
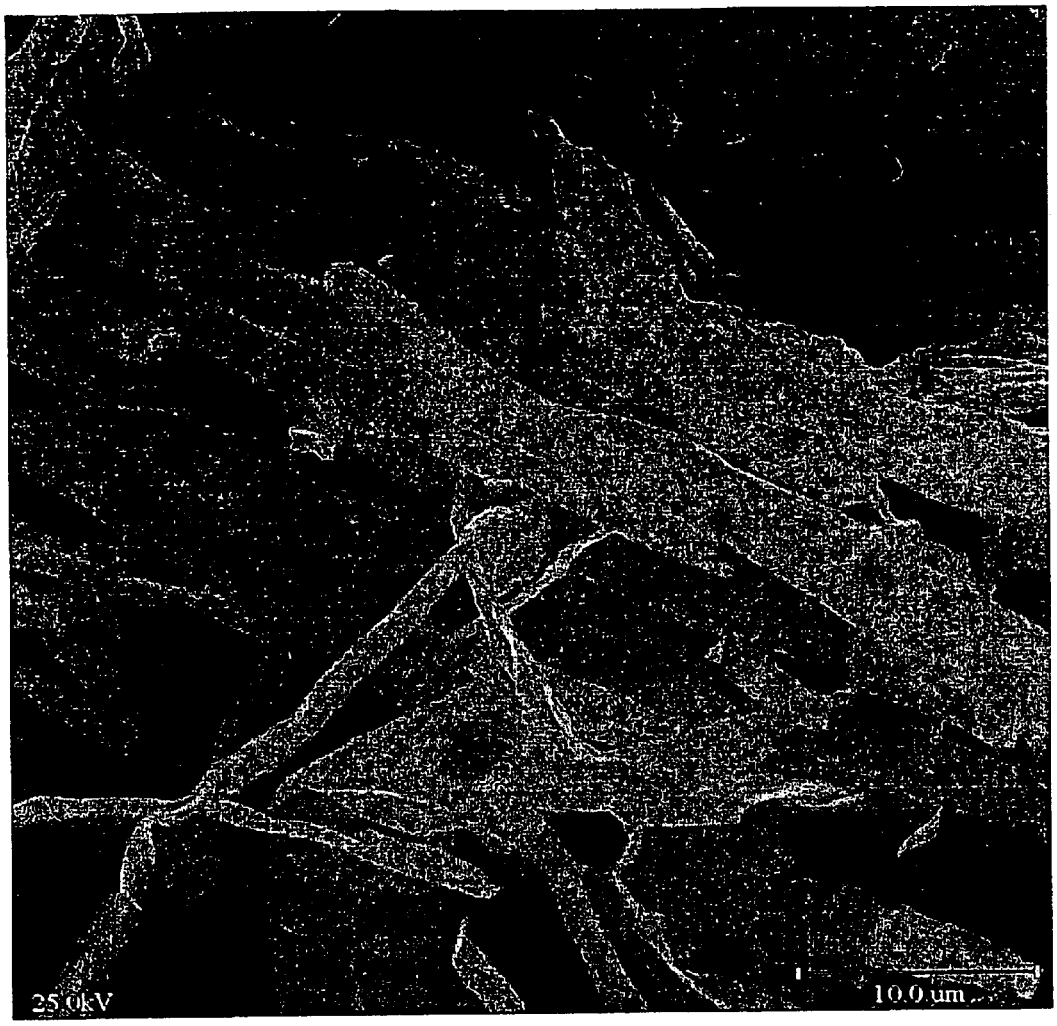
FIGS. 7B, 7C, 7D, and 7E photomicrographs using SEI of the some of the shapes of the fibers of FIG. 7A at 2000 times.
Figure 7C:
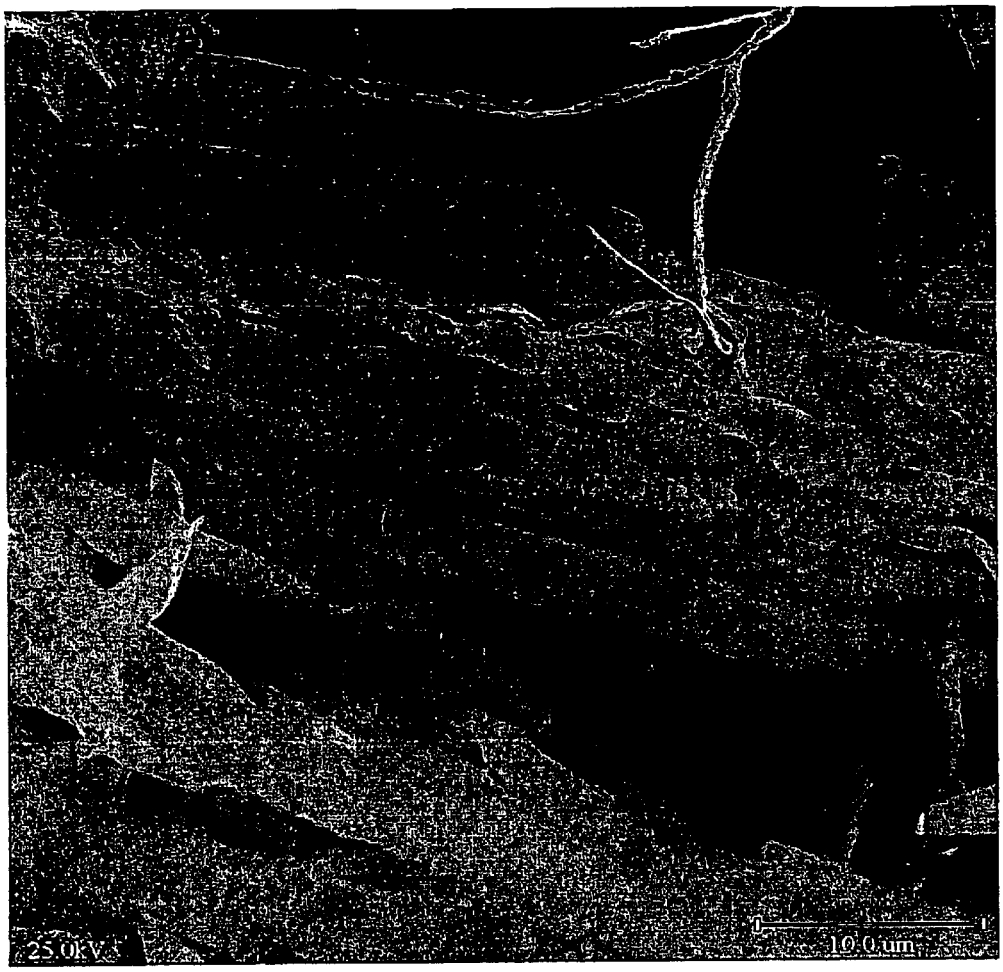
Figure 7D:
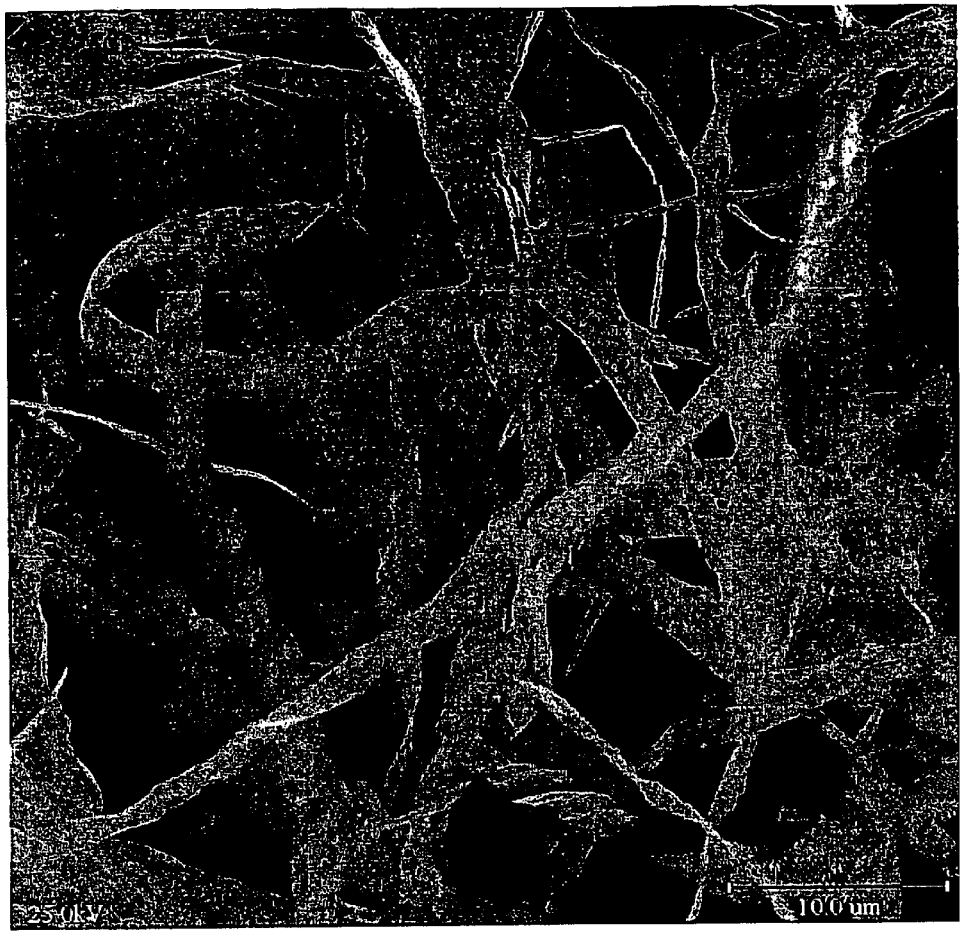
Figure 7E:
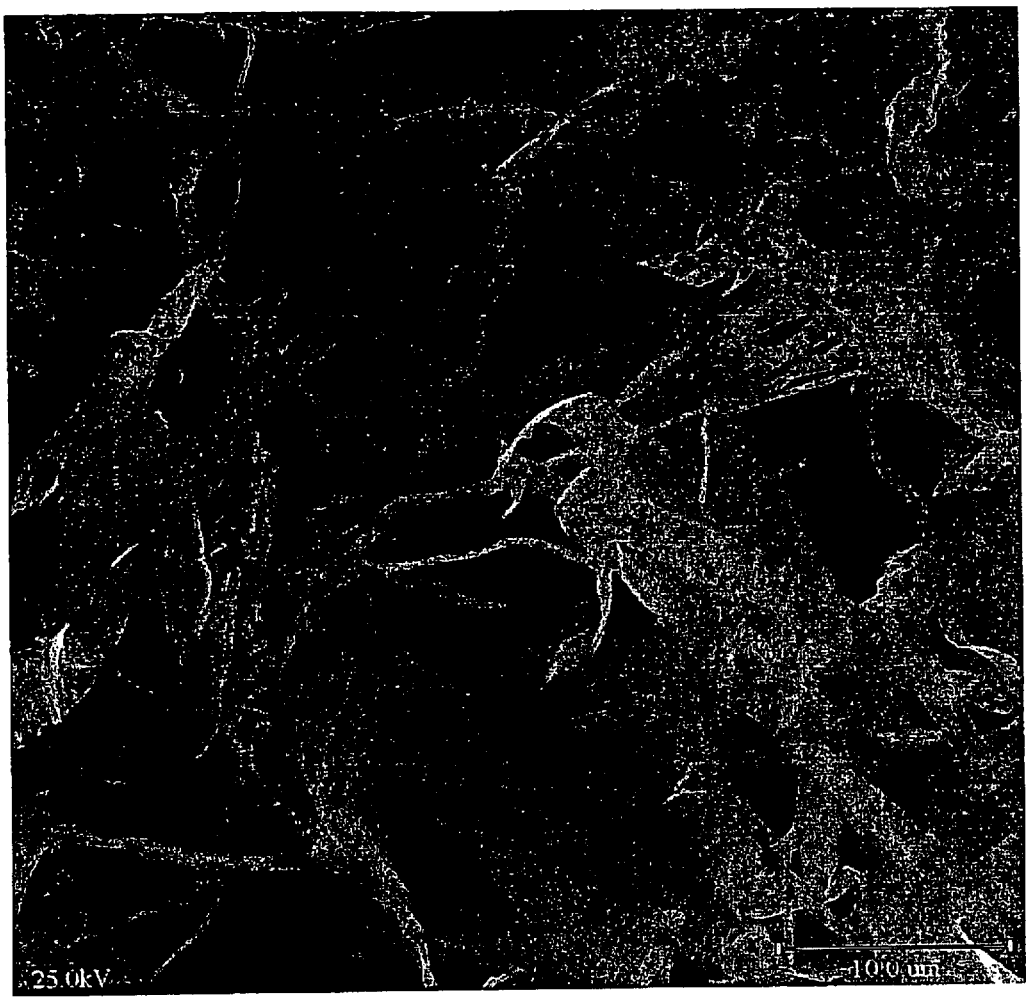
Figure 8:
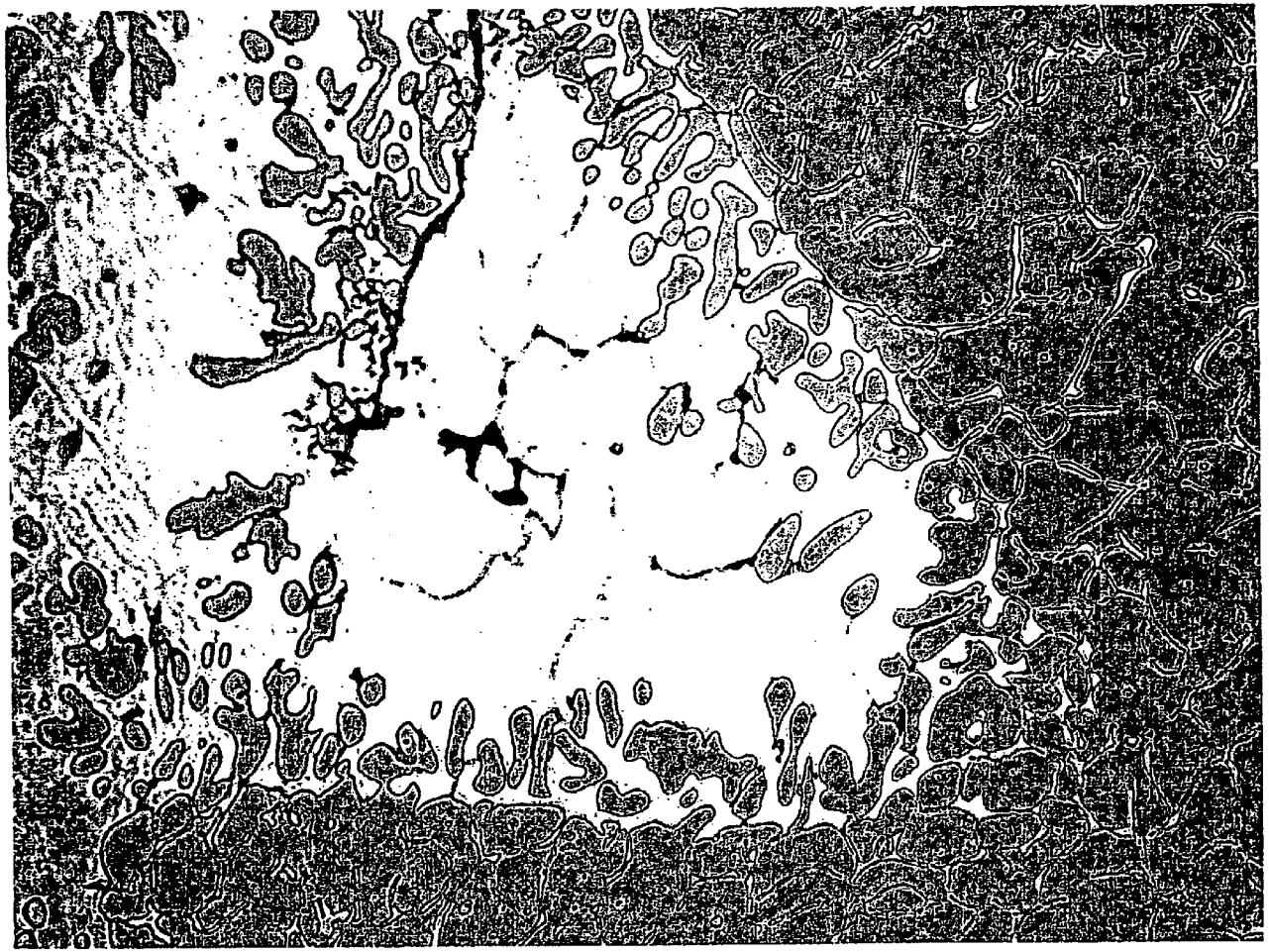
FIG. 8 is a photomicrograph of a cross section of a bulk matrix at 500 times magnification prepared from an embodiment of the method of the present invention comprising melting a mixture including C-103 and copper, the photomicrograph showing the dendritic shape of the fiber phase in the matrix phase.
Figure 9:
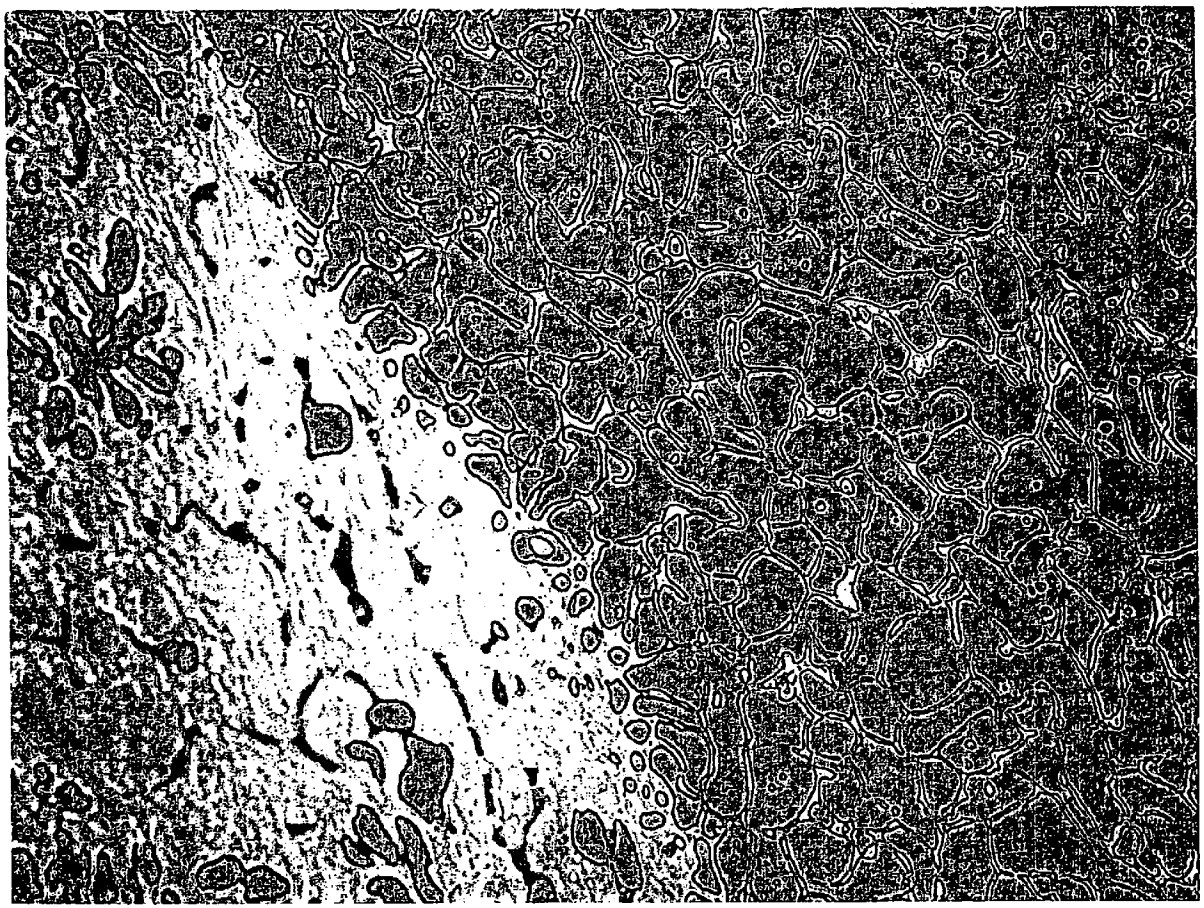
FIG. 9 is another photomicrograph of a cross section of a bulk matrix at 500 times magnification prepared from an embodiment of the method of the present invention comprising melting a mixture including C-103 and copper, the photomicrograph showing the dendritic shape of the fiber phase in the matrix phase.
Figure 10:
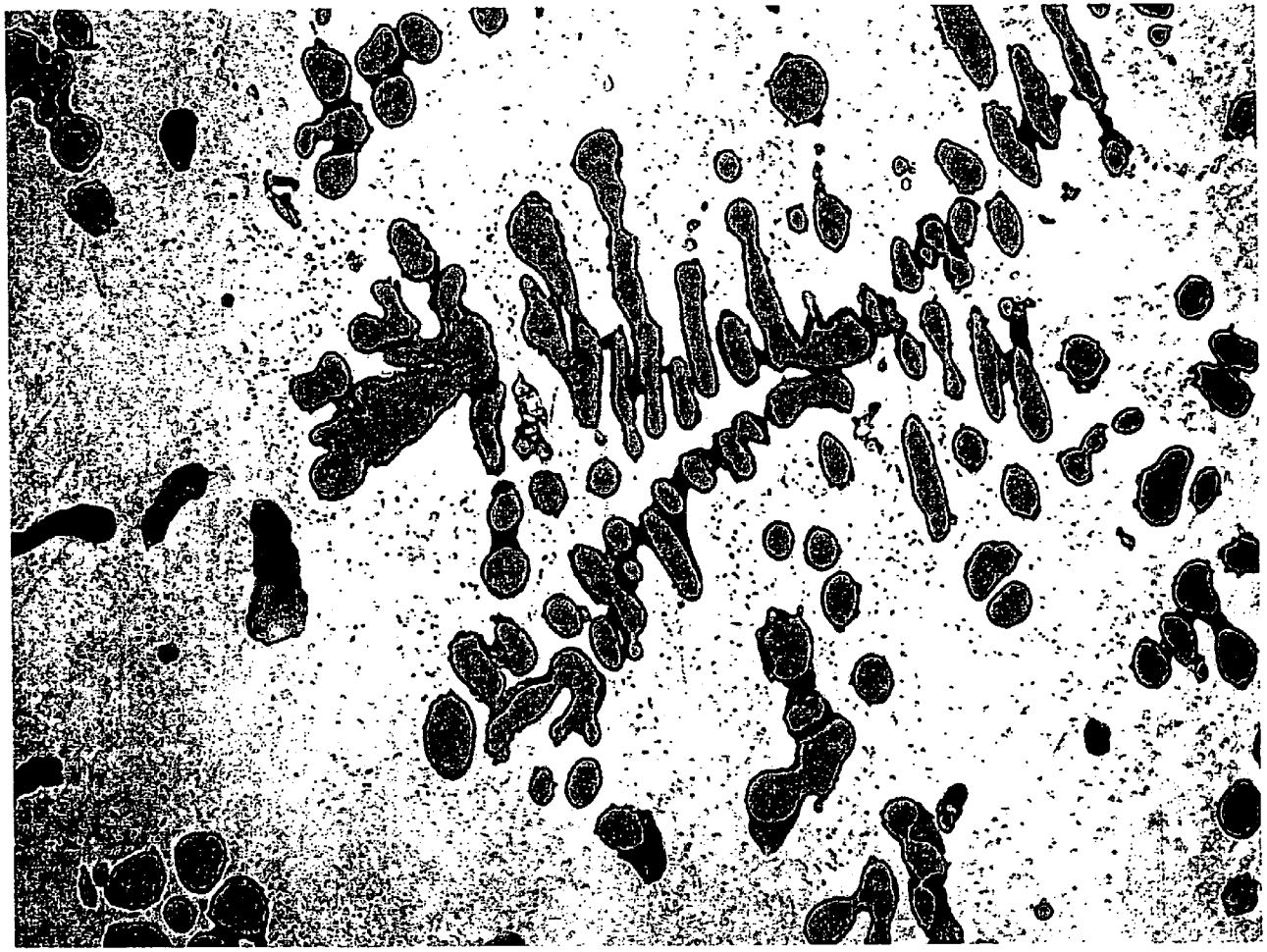
FIG. 10 is another photomicrograph of a cross section of a bulk matrix at 1000 times magnification prepared from an embodiment of the method of the present invention comprising melting C-103 and copper, the photomicrograph showing the dendritic shape of the fiber phase in the matrix phase.

Optionally, the fiber phase in the bulk matrix may subsequently be altered in size, shape and form via any of several mechanical processing steps for deforming the bulk matrix. The mechanical processing steps for deforming the bulk matrix may be any known mechanical process, or combination of mechanical processes, including, but not limited to, hot rolling, cold rolling, pressing, extrusion, forging, drawing, or any other suitable mechanical processing method. For example, FIGS. 3 and 4A–D are photomicrographs of dendrites of niobium in a copper matrix after a mechanical processing step. FIGS. 3 and 4–D were prepared from a melt mixture including C-103 and copper. The mixture was melted and cooled to form a button. The button was subsequently deformed by rolling to reduce the cross-sectional area. By a comparison of FIGS. 1 and 2 of a similar bulk matrix prior to deformation with FIGS. 3 and 4–D, the effects of the mechanical processing can easily be seen on the morphology of the fiber phase in the matrix phase. Deformation of the bulk matrix may result in at least one of the elongation and reduction of cross sectional area of the contained fiber phase. The wrought processing may be used to transform the bulk matrix into any suitable form such as wire, rod, sheet, bar, strip, extrusion, plate, or flattened particulate.

The fiber metal may subsequently be retrieved from the bulk matrix by any known means for recovery of the matrix phase substantially free of the fiber phase. For example, in an embodiment comprising a copper matrix metal, the copper may be dissolved in any substance that will dissolve the matrix metal without dissolving the fiber metal, such as a mineral acid. Any suitable mineral acid may be used, such as, but not limited to, nitric acid, sulfuric acid, hydrochloric acid, or phosphoric acid, as well as other suitable acids or combination of acids. The matrix metal may also be removed from the bulk matrix by electrolysis of the matrix metal by known means.

The metal fibers removed from the bulk matrix may have a high surface area to mass ratio when in the form of a dendrite, as defined herein. The fiber material may be used in bulk as a corrosion resistant filter material, membrane support, substrate for a catalyst, or other application that may utilize the unique characteristics of the filamentary material. The fiber material may be further processed to meet the specific requirements of a specific application. These further processing steps may include sintering, pressing, or any other step necessary to optimize the properties of the filamentary material in a desired way. For example, the fiber material may be rendered into a powder-like consistency through high-speed shearing in a viscous fluid, hydride dehydride and crushing process. Optionally, freezing a slurry of the fiber material in small ice pellets permits further shortening of the filaments by processing in a blender.

Metal fibers as processed or with further processing are recognized as a prime form for capacitor use. In many capacitor applications, the more abundant and less costly niobium, alone or alloyed, may serve as an effective substitute for tantalum. The lower cost niobium and its alloys compared to tantalum, in combination with a large supply and the method of the present invention, present an optimum material for miniature capacitor uses in small electronics. Niobium and tantalum capacitor applications desire a fine, high surface area product, on the order of 1–5 microns in size and a surface area of greater than 2 $m^2$/gram.

Melting Procedures

The melting processes described in the following examples took place under a vacuum of at least $10^{-3}$ Torr or under an atmosphere of inert gas. Using this environment during the melting process considerably reduce oxygen incorporation into the metal. Although the Examples were conducted in this manner, the embodiments of the method of forming fibers do not necessarily require any step to be performed under vacuum or under an atmosphere of inert gas. The melting step of the method may include any process capable of achieving a molten state of the fiber metal and matrix metal.

In certain embodiments of the method, it may be advantageous to minimize the incorporation of oxygen into the metal fibers while other applications of metal fibers, such as filter media and catalyst supports, may not be affected by oxygen. Once the fiber metal is enveloped in the molten matrix metal, it is further protected against atmospheric contamination and the only significant potential for contamination is a possible reaction at the interface of the fiber metal/matrix metal and the atmosphere. For embodiments wherein a minimum of atmospheric contamination is desired, the fiber metal may be added in a fine particle size.

The method for producing fibers will be described by certain examples indicated below. The examples are provided to describe embodiments of the method without limiting the scope of the claims.

EXAMPLES

Unless otherwise indicated, all numbers expressing quantities of ingredients, composition, time, temperatures, and so forth used in the present specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, may inherently contain certain errors necessarily resulting from the standard deviation found in their respective testing measurements.

Example 1

A mixture of 50 wt % niobium and 50 wt % copper was melted to form a button, cooled and rolled into the form of a plate. The resulting plate was chopped or sheared to short lengths and etched with a mineral acid to remove the copper from the niobium metal fiber. The resulting mixture was filtered to remove the metal fibers from the mineral acid.

Example 2

A mixture of 5 wt % niobium and 95 wt % copper was melted to form a button, cooled and rolled into the form of a plate. The resulting plate was chopped or sheared to about 1 inch squares and etched with a mineral acid to remove the copper from the niobium metal fibers. The resulting mixture was filtered to remove the fibers from the mineral acid.

Example 3

A mixture of 15 wt % niobium and 85 wt % copper was melted to form a button, cooled and rolled into the form of a plate. The resulting plate was chopped or sheared to about 1 inch squares and etched with a mineral acid to remove the copper from the niobium. The resulting mixture was filtered to remove the fibers from the mineral acid. SEM of niobium metal fibers produced in the example are shown in FIGS. 5A–5H.

Example 4

A mixture of 24 wt % niobium and 76 wt % copper was melted to form a button, cooled and rolled out to one tenth the original thickness into the form of a plate. The resulting plate was chopped or sheared to about 1 inch squares and etched with a mineral acid to remove the copper from the niobium fiber metal. The resulting mixture was filtered to remove the fibers from the mineral acid.

Example 5

A mixture of niobium and copper was melted with an addition of 2.5 wt % zirconium to form a button, cooled and rolled out to one tenth the original thickness into the form of a plate. The resulting plate was chopped or sheared to about 1 inch squares and etched with a mineral acid to remove the copper from the niobium fiber metal. The resulting mixture was filtered to remove the metal fibers from the mineral acid. The fibers appeared to have more surface area than the fibers formed without the addition of zirconium. SEI photomicrographs of the recovered fibers are shown in FIGS. 6A–6D.

Example 6

A mixture of 23 wt % niobium, 7.5 wt % Ta and copper was melted to form a button, cooled and rolled into a plate having a thickness of 0.022 inches. The resulting plate was chopped or sheared to about 1 inch squares and etched with a mineral acid to remove the copper from the niobium fiber metal. The resulting mixture was filtered to remove the niobium fibers from the mineral acid. The fibers were washed then sintered in two batches, one at 975° C. and the second batch at 1015° C. No shrinkage in size of the fibers was evident.

Example 7

A mixture of 23 wt. % C-103 alloy and copper was melted to form a button, cooled and rolled into a plate having a thickness of 0.022 inches. The resulting plate was chopped or sheared to about 1 inch squares and etched with a mineral acid to remove the copper from the niobium fiber metal. The resulting mixture was filtered to remove the niobium fibers from the mineral acid. The fibers were washed then sintered in two batches, one at 975° C. and the second batch at 1015° C. No shrinkage in size of the fibers was evident. Photomicrographs of the fibers are shown in FIGS. 7A–7E.

Example 8

A mixture of a C-103 alloy and copper was vacuum arc remelted ("VAR") to form an ingot, cooled and rolled into a plate having a thickness of 0.055 inches. Photomicrographs of cross sections of various bulk matrixes having similar composition shown in FIGS. 8–10. The resulting plate was chopped or sheared and etched with a mineral acid to remove the copper from the niobium fiber metal. The resulting mixture was filtered to remove the fibers from the mineral acid.

Example 9

Figure 11:
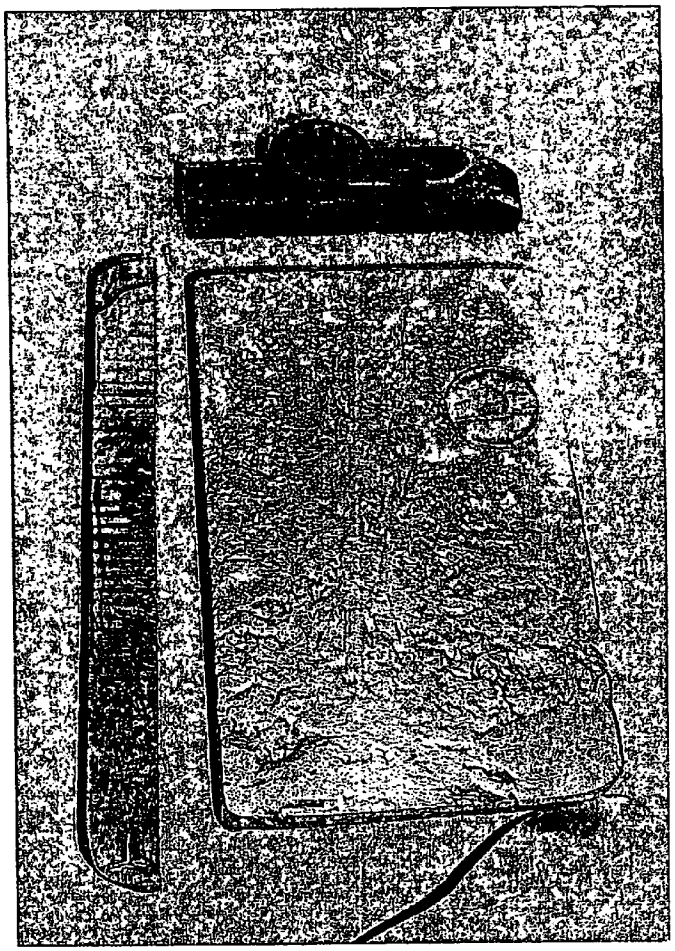
FIG. 11 depicts a bulk matrix in the form of a slab produced from an embodiment of the method of the present invention comprising melting a mixture including C-103 and copper and cooling the mixture into 0.5 inch slab.
Figure 12A:
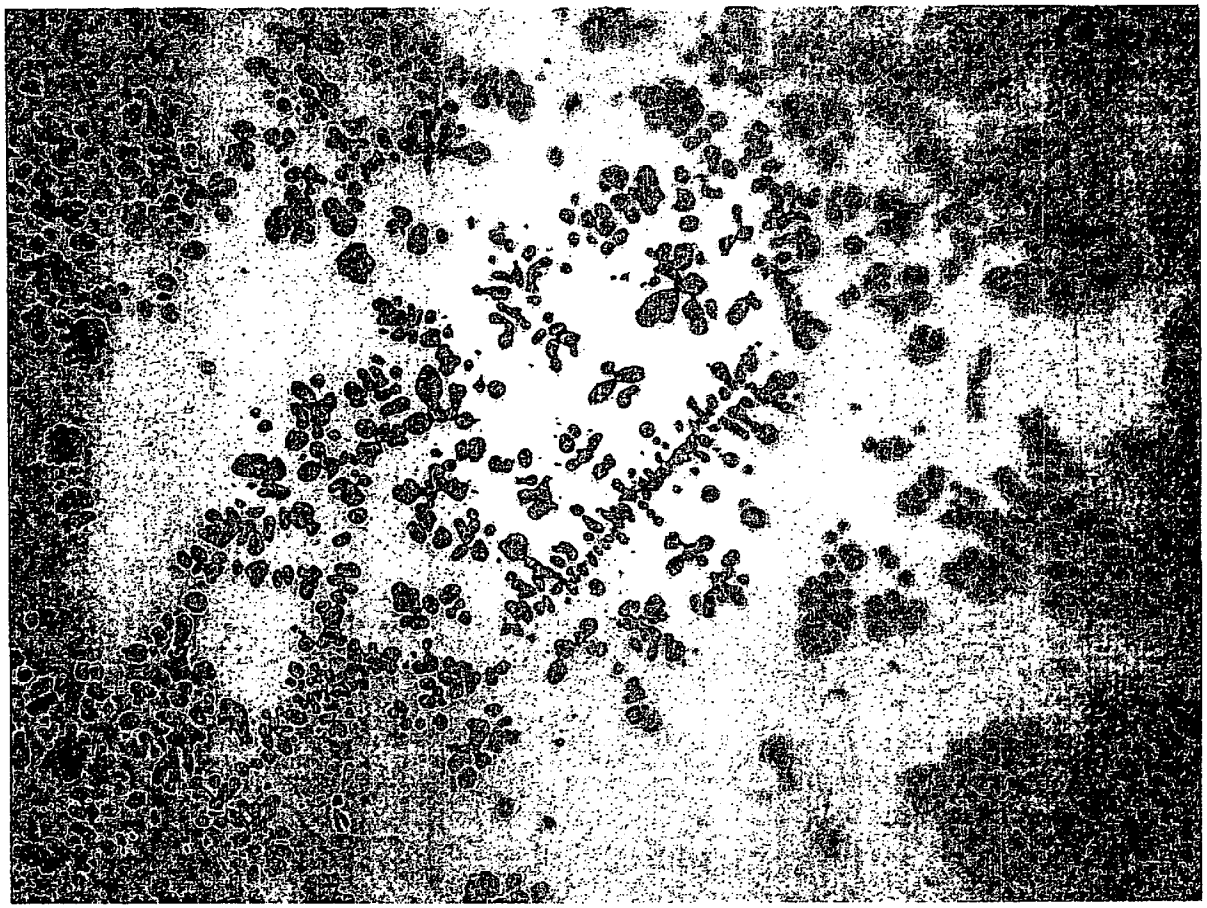
FIGS. 12A, 12B, and 12C are photomicrographs of a cross section of a bulk matrix of FIG. 11 at 500 times magnification, the photomicrographs showing the dendritic shape of the fiber phase in the matrix phase.
Figure 12B:
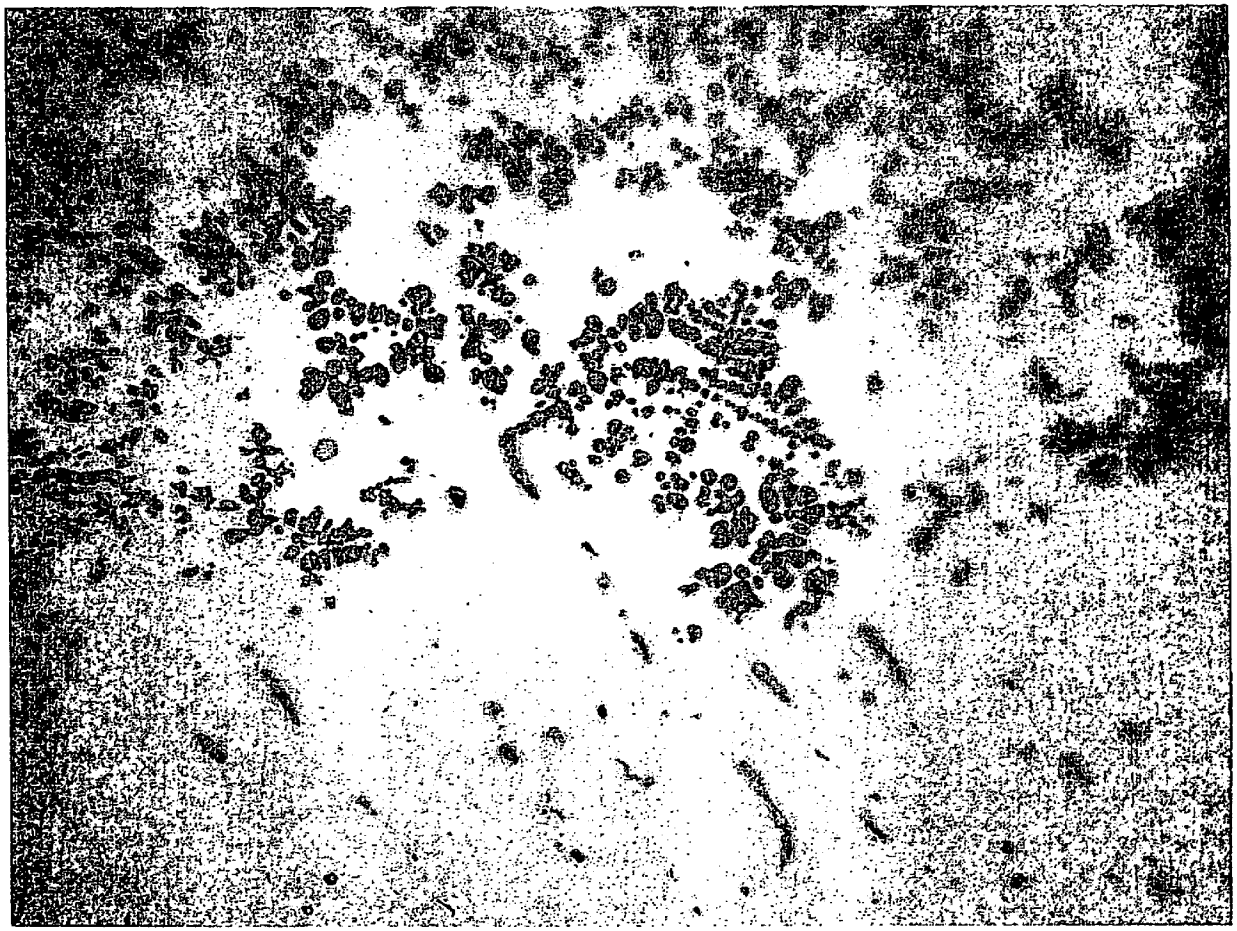
Figure 12C:
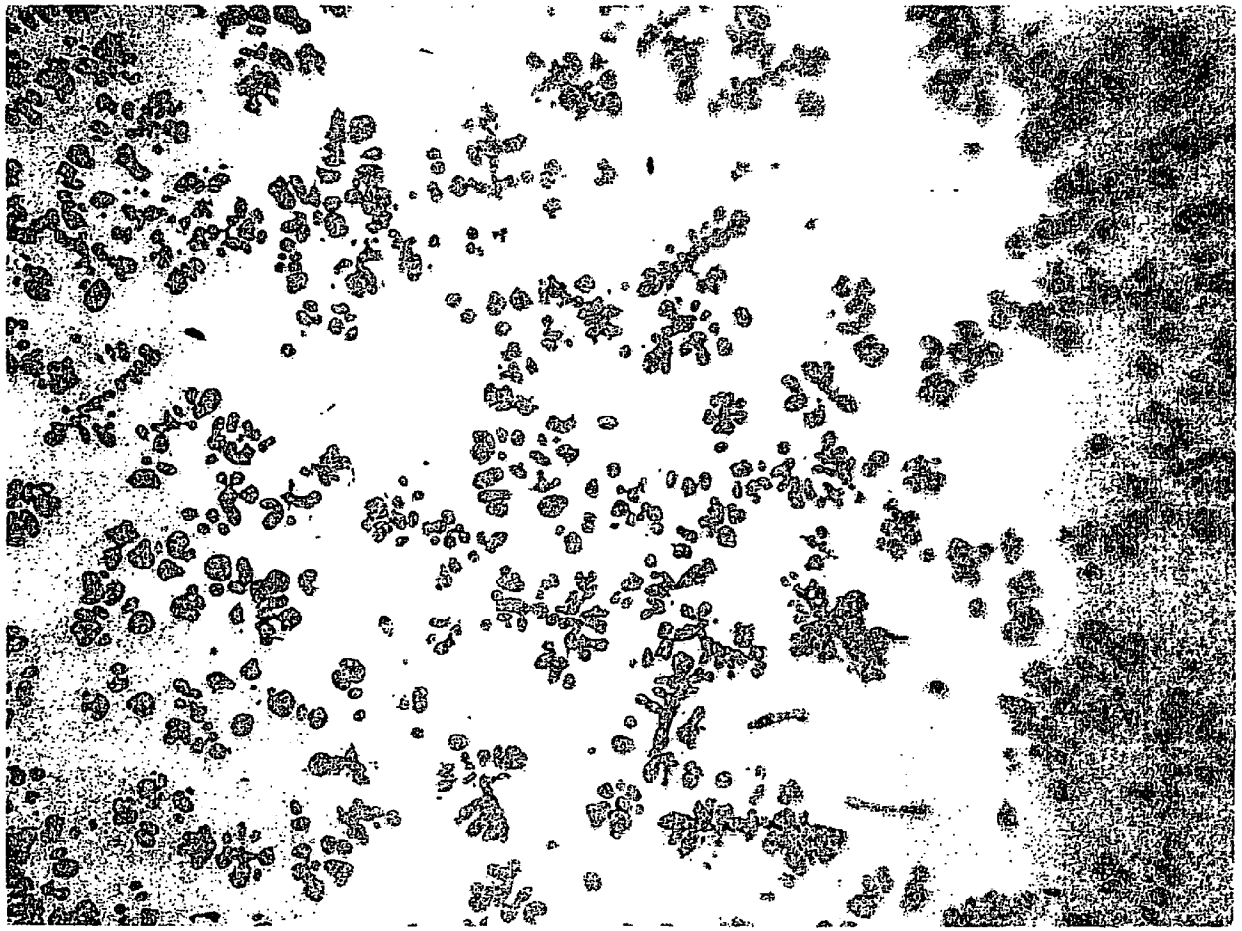

A mixture of a C-103 alloy and copper was vacuum arc remelted ("VAR") to form an ingot, cooled, induction melted and cast in a 0.5 inch thick graphite slab mold. The resulting bulk matrix in the form of a slab is shown in FIG. 11. Photomicrographs of the cross sections of the bulk matrix are shown in FIGS. 12A–12C. The slab was cross rolled, and the matrix phase was then removed from the fiber phase with five mineral acid washes and several rinses. The resulting fibers, see FIGS. 7A–7E, had a composition of niobium comprising the following additional components:

| | |
|---|---|
| carbon | 1100 ppm, |
| chromium | <20 ppm, |
| copper | 0.98 wt %, |
| iron | 320 ppm, |
| hydrogen | 180 ppm, |
| hafnium | 1400 ppm, |
| nitrogen | 240 ppm, |
| oxygen | 0.84 wt %, and |
| titanium | 760 ppm. |

This analysis indicates that a portion of some components of the fiber metal may end up in the matrix phase and a portion of some components of the matrix metal may end up in the fiber phase in embodiments of the present invention.

Example 10

A mixture of 25 wt % niobium and 75 wt % copper was melted to form a button, cooled and rolled out to a thickness of approximately 0.018 to 0.020 inches into the form of a plate. The resulting plate was etched in nitric acid to remove the copper from the niobium fiber metal. When the plate was added to the acid, the nitric acid began to boil and the metal fiber floated to the top. When the boiling stopped, the niobium fiber material dropped to the bottom. The resulting mixture was filtered to remove the fibers from the mineral acid.

It is to be understood that the present description illustrates those aspects of the invention relevant to a clear understanding of the invention. Certain aspects of the invention that would be apparent to those of ordinary skill in the art and that, therefore, would not facilitate a better understanding of the invention have not been presented in order to simplify the present description. Although embodiments of the present invention have been described, one of ordinary skill in the art will, upon considering the foregoing description, recognize that many modifications and variations of the invention may be employed. All such variations and modifications of the invention are intended to be covered by the foregoing description and the following claims.

What is claimed is:

1. A method of producing metal fibers, comprising:

melting a mixture of at least a fiber metal and a matrix metal;

cooling the mixture to form a bulk matrix comprising at least a fiber phase and a matrix phase; and removing at least a substantial portion of the matrix phase from the fiber phase, wherein at least one of a morphology, a size, and an aspect ratio of fiber in the fiber phase is modified by adjusting at least one process parameter.

2. The method of claim 1, wherein the mixture is a eutectic mixture.

3. The method of claim 1, wherein the fiber phase comprises one of a metal and a metal alloy.

4. The method of claim 1, wherein the fiber metal is at least one of niobium, a niobium alloy, tantalum and a tantalum alloy.

5. The method of claim 1, wherein matrix metal is at least one of copper and a copper alloy.

6. The method of claim 1, wherein melting the mixture comprises at least one of vacuum arc remelting, induction melting, continuous casting, continuous casting strip over cooled counter-rotating rolls, squeeze-type casting, and rotating electrode powder melting.

7. The method of claim 1, wherein the fiber phase is in the form of dendrites in the matrix phase.

8. The method of claim 7, wherein the dendrites are in the form of tree-like branching dendrites.

9. The method of claim 7, wherein the dendrites have a surface area of at least 2.0 $m^2/g$.

10. The method of claim 1, further comprising:

deforming the bulk matrix.

11. The method of claim 10, wherein deforming the bulk matrix includes at least one of hot rolling, cold rolling, extruding, forging, drawing, and other mechanical processing methods.

12. The method of claim 11, wherein the deforming the bulk matrix results in at least one of elongating the bulk matrix and reducing a cross-sectional area of the bulk matrix.

13. The method of claim 11, wherein the bulk matrix comprises at least one of fibers and dendrites of the fiber phase in a matrix of the matrix phase, and deforming the bulk matrix alters at least one of a size, shape, and form of the fiber phase.

14. The method of claim 1, wherein removing a substantial portion of the matrix phase from the fiber phase comprises at least one of dissolving the matrix phase and electrolysis of the matrix phase.

15. The method of claim 14, wherein dissolving the matrix phase comprises dissolving the matrix phase in a suitable mineral acid.

16. The method of claim 15, wherein the mineral acid is at least one of nitric acid, sulfuric acid, hydrochloric acid and phosphoric acid.

17. The method of claim 1, wherein after removing at least a substantial portion of the matrix phase, the fiber phase is in the form of a dendrite.

18. The method of claim 17, wherein the fiber phase is in the form of at least one of a fiber, needle, ribbon, and a rounded shape.

19. The method of claim 1, wherein the weight percentage of the fiber metal in the mixture is greater than 0 wt and less than 70 wt %.

20. The method of claim 1, wherein the weight percentage of the fiber metal in the mixture is from 15 wt % to 25 wt %.

21. The method of claim 1, wherein adjusting at least one process parameter comprises adjusting at least one of a ratio of metals in the melt, a melting rate, a solidification rate, a solidification geometry, a melting method, a solidification method, a molten pool volume, and an addition of other alloying elements.

22. The method of claim 1, wherein the weight percentage of the fiber metal in the mixture is from greater than 0 wt % to 50 wt %.

23. The method of claim 1, wherein the weight percentage of the fiber metal in the mixture is from 5 wt % to 50 wt %.

24. The method of claim 1, wherein the weight percentage of the fiber metal in the mixture is from 15 wt % to 50 wt %.

25. The method of claim 1, wherein the weight percentage of the fiber metal in the mixture is from greater than 0 wt % to 35 wt %.

26. The method of claim 1, wherein the fiber phase has an oxygen content of 1.5 wt % or less.

27. The method of claim 1, wherein the fiber metal has a form prior to melting of at least one of rods, plate machine chips, machine turnings, fine input stock and coarse input stock.

28. The method of claim 1, further comprising:

processing the fiber phase after removing at least a substantial portion of the matrix phase, wherein processing the fiber phase comprises at least one of sintering the fiber phase, pressing the fiber pahse, washing the fiber phase, rendering the fiber phase into a powder-like consistency, and shortening the fibers of the fiber phase.

29. The method of claim 28, wherein processing the fiber phase comprises rendering the fiber phase into a powder-like consistency by high-speed shearing of the fiber phase in a viscous fluid, hydride dehydride and crushing process.

30. The method of claim 28, wherein processing the fiber phase comprises shortening the fibers of the fiber phase by freezing a slurry of the fiber phase into a plurality of small ice pellets and processing the plurality of small ice pellets in a blender.

31. A method of producing metal fibers, comprising:

melting a mixture of at least niobium and copper;

cooling the mixture to form a bulk matrix comprising at least a fiber phase comprising a significant portion of the niobium and a matrix phase comprising a significant portion of the copper; and removing at least a substantial portion of the matrix phase from the fiber phase;

wherein at least one of a morphology, a size, and an aspect ratio of fiber in the fiber phase is modified by adjusting at least one process parameter.

32. The method of claim 31, wherein melting the mixture comprises at least one of vacuum arc remelting, induction melting, continuous casting, continuous casting strip over cooled counter-rotating rolls, squeeze-type casting, and rotating electrode powder melting.

33. The method of claim 31, wherein the weight percentage of the fiber metal in the mixture is from 15 wt. % to 25 wt. %.

34. The method of claim 31, further comprising:

deforming the bulk matrix.

35. The method of claim 34, wherein deforming the bulk matrix includes at least one of hot rolling, cold rolling, extruding, forging, drawing, and other mechanical processing methods.

36. The method of claim 34, wherein deforming the bulk matrix comprises cold rolling the bulk matrix.

37. The method of claim 31, wherein the fiber phase is in the form of dendrites in the matrix phase.

38. The method of claim 37, wherein the dendrites are in the form of tree-like branching dendrites.

39. The method of claim 37, wherein the dendrites have a surface area of at least 2.0 $m^2/g$.

40. The method of claim 31, wherein the weight percentage of the fiber metal in the mixture is from greater than 0 wt % to 50 wt %.

41. The method of claim 31, wherein the weight percentage of the fiber metal in the mixture is from 5wt % to 50wt %.

42. The method of claim 31, wherein the weight percentage of the fiber metal in the mixture is from 15 wt % to 50wt %.

43. The method of claim 31, wherein the weight percentage of the fiber metal in the mixture is from greater than 0 wt % to 35 wt %.

44. The method of claim 31, wherein the fiber phase has an oxygen content of 1.5 wt % or less.

45. The method of claim 31, wherein the fiber metal has a form prior to melting of at least one of rods, plate machine chips, machine turnings, fine input stock and coarse input stock.

46. The method of claim 31, wherein the fiber phase comprises an alloy comprising niobium, 10 wt % hafnium, 0.7 to 1.3 wt % titanium, 0.7 wt % zirconium, and 0.5 wt % tungsten.

47. The method of claim 31, wherein removing a substantial portion of the matrix phase from the fiber phase comprises at least one of dissolving the matrix phase and electrolytes.

48. The method of claim 47, wherein dissolving the matrix metal comprises dissolving the matrix metal in a suitable mineral acid.

49. The method of claim 48, wherein the mineral acid is at least one of nitric acid, sulfuric acid, hydrochloric acid and phosphoric acid.

50. The method of claim 31, wherein after removing at least a substantial portion of the matrix phase, the fiber phase is in the form of a dendrite.

51. The method of claim 50, wherein the fiber phase is in the form of at least one of a fiber, needle, ribbon, and a rounded shape.

52. The method of claim 54, wherein processing the fiber phase comprises shortening the fibers of the fiber phase by freezing a slurry of the fiber phase into a plurality of small ice pellets and processing the plurality of small ice pellets in a blender.

53. The method of claim 31, wherein adjusting at least one process parameter comprises adjusting at least one of a ratio of metals in the melt, a melting rate, a solidification rate, a solidification geometry, a melting method, a solidification method, a molten pool volume, and an addition of other alloying elements.

54. The method of claim 31, further comprising:

processing the fiber phase after removing at least a substantial portion of the matrix phase, wherein processing the fiber phase comprises at least one of sintering the fiber phase, pressing the fiber phase, washing the fiber phase, rendering the fiber phase into a powder-like consistency, and shortening the fibers of the fiber phase.

55. The method of claim 54, wherein processing the fiber phase comprises rendering the fiber phase into a powder-like consistency by high-speed shearing of the fiber phase in a viscous fluid, hydride dehydride and crushing process.

56. A method of producing metal fibers, comprising:

melting a mixture of at least a fiber metal and a matrix metal;

cooling the mixture to form a bulk matrix comprising at least a fiber phase and a matrix phase;

removing at least a substantial portion of the matrix phase from the fiber phase; and processing the fiber phase, wherein processing the fiber phase comprises at least one of sintering the fiber phase, pressing the fiber phase, washing the fiber phase, rendering the fiber phase into a powder-like consistency, and shortening the fibers of fiber phase.

57. The method of claim 56, wherein processing the fiber phase comprises rendering the fiber phase into a powder-like consistency by high-speed shearing of the fiber phase in a viscous fluid, hydride dehydride and crushing process.

58. The method of claim 56, wherein processing the fiber phase comprises shortening the fibers of the fiber phase by freezing a slurry of the fiber phase into a plurality of small ice pellets and processing the plurality of small ice pellets in a blender.

59. The method of claim 56, further comprising:

deforming the bulk matrix.

60. A method of producing metal fibers, comprising:

melting a mixture of at least niobium and copper;

cooling the mixture to form a bulk matrix comprising at least a fiber phase comprising a significant portion of the niobium and a matrix phase comprising a significant portion of the copper;

removing at least a substantial portion of the matrix phase from the fiber phase; and processing the fiber phase, wherein processing the fiber phase comprises at least one of sintering the fiber phase, pressing the fiber phase, washing the fiber phase, rendering the fiber phase into a powder-like consistency, and shortening the fibers of the fiber phase.

61. The method of claim 60, wherein processing the fiber phase comprises rendering the fiber phase into a powder-like consistency by high-speed shearing of the fiber phase in a viscous fluid, hydride dehydride and crushiing process.

62. The method of claim 60, wherein processing the fiber phase comprises shortening the fibers of the fiber phase by freezing a slurry of the fiber phase into a plurality of small ice pellets and processing the plurality of small ice pellets in a blender.

63. The method of claim 60, further comprising:

deforming the bulk matrix.

* * * * *